US010532366B2

(12) United States Patent
Tomaru

(10) Patent No.: US 10,532,366 B2
(45) Date of Patent: Jan. 14, 2020

(54) ROTOR ATTACHMENT STRUCTURE AND CENTRIFUGE

(71) Applicant: KUBOTA MANUFACTURING CORPORATION, Tokyo (JP)

(72) Inventor: Satoshi Tomaru, Gunma (JP)

(73) Assignee: KUBOTA MANUFACTURING CORPORATION, Tokyo (JP)

( * ) Notice: Subject to any disclaimer, the term of this patent is extended or adjusted under 35 U.S.C. 154(b) by 0 days.

(21) Appl. No.: 16/316,246

(22) PCT Filed: Jul. 13, 2016

(86) PCT No.: PCT/JP2016/070695
§ 371 (c)(1),
(2) Date: Jan. 8, 2019

(87) PCT Pub. No.: WO2018/011910
PCT Pub. Date: Jan. 18, 2018

(65) Prior Publication Data

US 2019/0299221 A1 Oct. 3, 2019

(51) Int. Cl.
*B04B 9/08* (2006.01)
*B04B 7/00* (2006.01)

(52) U.S. Cl.
CPC ..... *B04B 9/08* (2013.01); *B04B 7/00* (2013.01); *B04B 2009/085* (2013.01)

(58) Field of Classification Search
CPC ..... B04B 9/00; B04B 9/08; B04B 2009/085; B04B 7/00; F16D 1/108
(Continued)

(56) References Cited

U.S. PATENT DOCUMENTS 4,753,631 A 6/1988 Romanauskas
5,681,257 A * 10/1997 Letourneur ..... B04B 9/08 403/325
(Continued)

FOREIGN PATENT DOCUMENTS

JP 2009-082922 A 4/2009
JP 5442337 B2 12/2013
(Continued)

OTHER PUBLICATIONS

IPER in International Application PCT/JP2016/070695 (Year: 2016).*
(Continued)

*Primary Examiner* — Charles Cooley
(74) *Attorney, Agent, or Firm* — Greenblum & Bernstein, P.L.C.

(57) ABSTRACT

An attachment fitting is attached inside a rotor hole. The attachment fitting is made up of a main body, first and second pieces disposed in a piece placement hole formed in the main body so as to pass therethrough in a direction orthogonal to a rotation central axis of a rotor, a leaf spring including two arm portions, and a retainer that is mounted on the main body and puts a base of the leaf spring between the retainer and the main body. The first and second pieces have grooves into which the arm portions of the leaf spring are inserted. When the rotor rotates, the first and second pieces protrude from the piece placement hole by the centrifugal force against the spring force of the leaf spring and make contact with a rotor coupling portion of a shaft.

13 Claims, 23 Drawing Sheets

(58) Field of Classification Search
USPC ..... 494/12, 16, 20, 33, 38, 64, 84, 85; 210/232
See application file for complete search history.

(56) References Cited

U.S. PATENT DOCUMENTS

| | | | | |
|---|---|---|---|---|
| 6,024,687 | A | 2/2000 | Cheng | |
| 6,063,018 | A * | 5/2000 | Letourneur | B04B 9/08 403/327 |
| 8,678,987 | B2 * | 3/2014 | Henne | B04B 9/08 494/12 |
| 9,339,824 | B2 * | 5/2016 | Henne | B04B 9/08 |
| 9,539,588 | B2 * | 1/2017 | Le Guyader | B04B 9/08 |
| 9,718,067 | B2 * | 8/2017 | Ballhause | B04B 9/00 |
| 10,300,499 | B2 * | 5/2019 | Hornek | B04B 9/08 |
| 2008/0146429 | A1 | 6/2008 | Woodman | |
| 2011/0212822 | A1 * | 9/2011 | Henne | B04B 9/08 494/84 |
| 2016/0158769 | A1 * | 6/2016 | Hornek | B04B 9/08 494/83 |
| 2017/0050194 | A1 * | 2/2017 | Hornek | B04B 7/00 |

FOREIGN PATENT DOCUMENTS

| | | | | |
|---|---|---|---|---|
| JP | 2016-002512 | A | 1/2016 | |
| WO | WO-9747893 | A1 * | 12/1997 | B04B 9/08 |

OTHER PUBLICATIONS

U.S. Appl. No. 15/772,647 to Yuya Takahashi et al., filed May 1, 2018.
International Search Report in International Patent Application No. PCT/JP2016/070695, dated Oct. 4, 2016, along with an English translation.

* cited by examiner

ROTOR ATTACHMENT STRUCTURE AND CENTRIFUGE

TECHNICAL FIELD

The present invention relates to a centrifuge and, in particular, relates to a rotor attachment structure.

BACKGROUND ART

FIG. 1 shows an internal structure of a centrifuge described in Patent Literature 1 and, in FIG. 1, 1 denotes a rotary shaft whose shaft center coincides with a vertical direction and 2 denotes a rotary head attached to the upper part of the rotary shaft. Moreover, 3 denotes a rotor which is disposed in the upper part of the rotary head 2 and 4 denotes a lid that covers the upper part of the rotor 3.

The rotor 3 includes a plurality of sample insertion portions 5 and also includes, for example, rotor holes 6 and 7 into which the rotary head 2 is inserted, a frame 8, male members 9-1 and 9-2, and a guide pin 10. The rotor hole 6 is a circular hole with a fixed diameter, and the rotor hole 7 is formed as a circular hole whose diameter decreases toward the inside of the hole.

The male members 9-1 and 9-2 are rotatable about rotating shafts 11-1 and 11-2 horizontally disposed in the rotor hole 6, the centers of gravity are located below the rotating shafts 11-1 and 11-2, and the male members 9-1 and 9-2 have projections 13-1 and 13-2 on the sides opposite to a shaft center 12 of the rotary shaft 1 below the centers of gravity. The male members 9-1 and 9-2 are attached to the frame 8, and the frame 8 is attached to the rotor 3. The rotor 3 has through holes 14 and 15, and the through hole 15 formed in the frame 8 is screw-threaded.

The rotary head 2 includes, in the upper part thereof, a rotor coupling portion 16 and drive pins 17. The rotor coupling portion 16 has the shape of a cylinder whose center coincides with the shaft center 12 of the rotary shaft 1, and has a ring-shaped depression 18 in the inner side face thereof. The rotary head 2 includes a circular cylinder portion 19 that is fitted into the rotor hole 6 and a truncated cone portion 20 that is fitted into the rotor hole 7. The lid 4 has a knob 21 and a screw portion 22 for threaded engagement with the through hole 15 of the frame 8.

The guide pin 10 can move only between the drive pins 17, and, when the rotary head 2 rotates, power is transferred to the guide pin 10 from the drive pins 17 and the rotor 3 rotates. When the rotary head 2 stops, the rotor 3 stops with the rotary head 2.

When the rotor 3 is disposed on the rotary head 2 in a state in which the rotary shaft 1 is stopped, the centers of gravity of the male members 9-1 and 9-2 are located immediately below the rotating shafts 11-1 and 11-2, and, at this time, the male members 9-1 and 9-2 are located inside the rotor coupling portion 16.

When the rotary shaft 1 rotates, the male members 9-1 and 9-2 move by the centrifugal force in such a way that the projections 13-1 and 13-2 are fitted into the depression 18 and, if a force that separates the rotor 3 from the rotary head 2 (a force that causes the rotor 3 to rise) is applied when the projections 13-1 and 13-2 are fitted into the depression 18, in this example, a force is applied to the projections 13-1 and 13-2 in a direction in which the projections 13-1 and 13-2 are fitted into the depression 18. Thus, even when an unexpected force that separates the rotor 3 from the rotary head 2 is applied during rotation, the projections 13-1 and 13-2 and the depression 18 are not separated from each other, which makes it possible to achieve reliable fixation.

PRIOR ART LITERATURE

Patent Literature

Patent Literature 1: Japanese Registered Patent No. 5442337

SUMMARY OF THE INVENTION

Problems to be Solved by the Invention

As described above, in the conventional rotor attachment structure, the male members 9-1 and 9-2 are rotatably disposed in the rotor 3 and, as a result of the male members 9-1 and 9-2 moving (rotating) by the centrifugal force which is generated at the time of rotation of the rotor 3 and the projections 13-1 and 13-2 of the male members 9-1 and 9-2 being fitted into the depression 18 of the rotary head 2, the rotor 3 is fixed to the rotary head 2.

However, such a structure requires the rotating shafts 11-1 and 11-2 that rotatably support the male members 9-1 and 9-2 and position the male members 9-1 and 9-2, that is, requires pins that constitute the rotating shafts 11-1 and 11-2, and attaching the male members 9-1 and 9-2 to such pins and attaching the pins to the rotor 3 are troublesome, which impairs ease of assembly.

An object of the present invention is to provide a rotor attachment structure that allows a rotor to be reliably fixed by simply being put and assembly on the rotor's side to be easily performed.

Means to Solve the Problems

According to the present invention, in a rotor attachment structure to a shaft in a centrifuge, a tip side of the shaft is a rotor coupling portion in a shape of a cylinder, a ring-shaped depression is formed in an inner periphery of the rotor coupling portion and a ring-shaped projection is formed on a side closer to a tip than the ring-shaped depression, a corner of the ring-shaped projection on an inner periphery thereof on a side where the ring-shaped depression is located is chamfered and a first shaft inclined surface is formed, and a face from the first shaft inclined surface to a bottom face of the ring-shaped depression is a second shaft inclined surface which forms an acute angle with the bottom face, and the rotor has a rotor hole into which the shaft is inserted and an attachment fitting is disposed in the rotor hole. The attachment fitting comprises: a main body that is housed in the rotor coupling portion; first and second pieces that are disposed in a piece placement hole formed in the main body so as to pass therethrough in a direction orthogonal to a rotation central axis of the rotor; a leaf spring that includes a base, two long and short extension portions formed by being bent from both ends of the base in the same direction, and two arm portions formed so as to extend from the tips of the extension portions in a shape of a circular arc so as to surround the rotation central axis, the leaf spring with the extension portions and the arm portions which are inserted into the piece placement hole via an opening formed in the main body above the piece placement hole so as to communicate with the piece placement hole; and a retainer that is mounted on the main body and puts the base between the retainer and the main body. The first piece has a first groove into which the arm portion formed in the long extension portion is inserted and includes, with the first groove placed therebetween, a first side wall portion located on one end side of the piece placement hole and a first central part located on the rotation central axis. The second piece has a second groove into which the arm portion formed in the short extension portion is inserted and includes, with the second groove placed therebetween, a second side wall portion located on another end side of the piece placement hole and a second central part located on the first central part. Each of outer side faces of the first side wall portion and the second side wall portion has a shape of a circular arc, and, in each of the outer side faces, a first inclined surface and a second inclined surface corresponding to a shape formed by the first shaft inclined surface and the second shaft inclined surface are formed respectively. In a state in which the rotor is stopped, the first and second pieces are positioned by the arm portions and located in the piece placement hole. When the rotor is rotated by the rotation of the shaft, the first and second pieces move by centrifugal force so as to protrude from one end and another end of the piece placement hole, respectively, against a spring force of the leaf spring and the first inclined surfaces make contact with the first shaft inclined surface. Rise of the rotor from the shaft is prevented as a result of the second inclined surfaces making contact with the second shaft inclined surface.

Effects of the Invention

According to the present invention, the first and second pieces move horizontally by the centrifugal force which is generated by the rotation of the rotor and make contact with the rotor coupling portion of the shaft, which causes the rotor and the shaft to be fastened together and makes it possible to prevent rise of the rotor, and it is possible to attach the rotor to the shaft by simply putting the rotor onto the shaft.

Moreover, unlike the conventional structure in which a member that moves by the centrifugal force is rotatably supported by a pin, there is no need for a pin and it is necessary simply to insert the first and second pieces into the piece placement hole, which makes it possible to perform assembly easily compared to the conventional structure.

DETAILED DESCRIPTION OF THE EMBODIMENTS

Hereinafter, embodiments of the present invention will be described.

Figure 2:
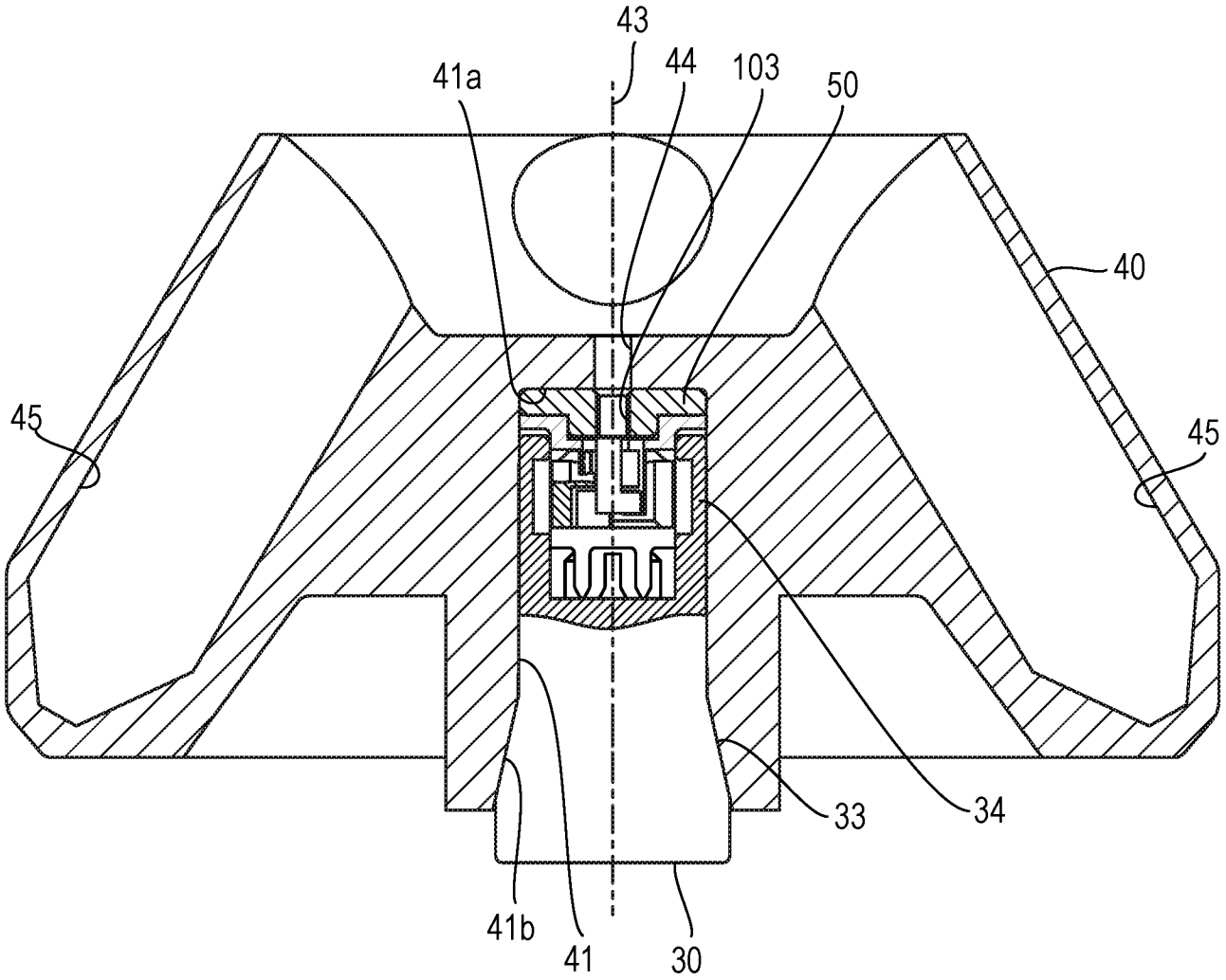
FIG. 2 is a sectional view of a rotor attachment structure according to an embodiment of the present invention.

FIG. 2 shows the internal structure of a centrifuge provided with an embodiment of a rotor attachment structure according to the present invention and, in FIG. 2, 30 denotes a shaft attached to a drive shaft (not shown in the drawing) of a motor and 40 denotes a rotor attached to the shaft 30. Moreover, 50 denotes an attachment fitting attached to the rotor 40.

Figure 3:
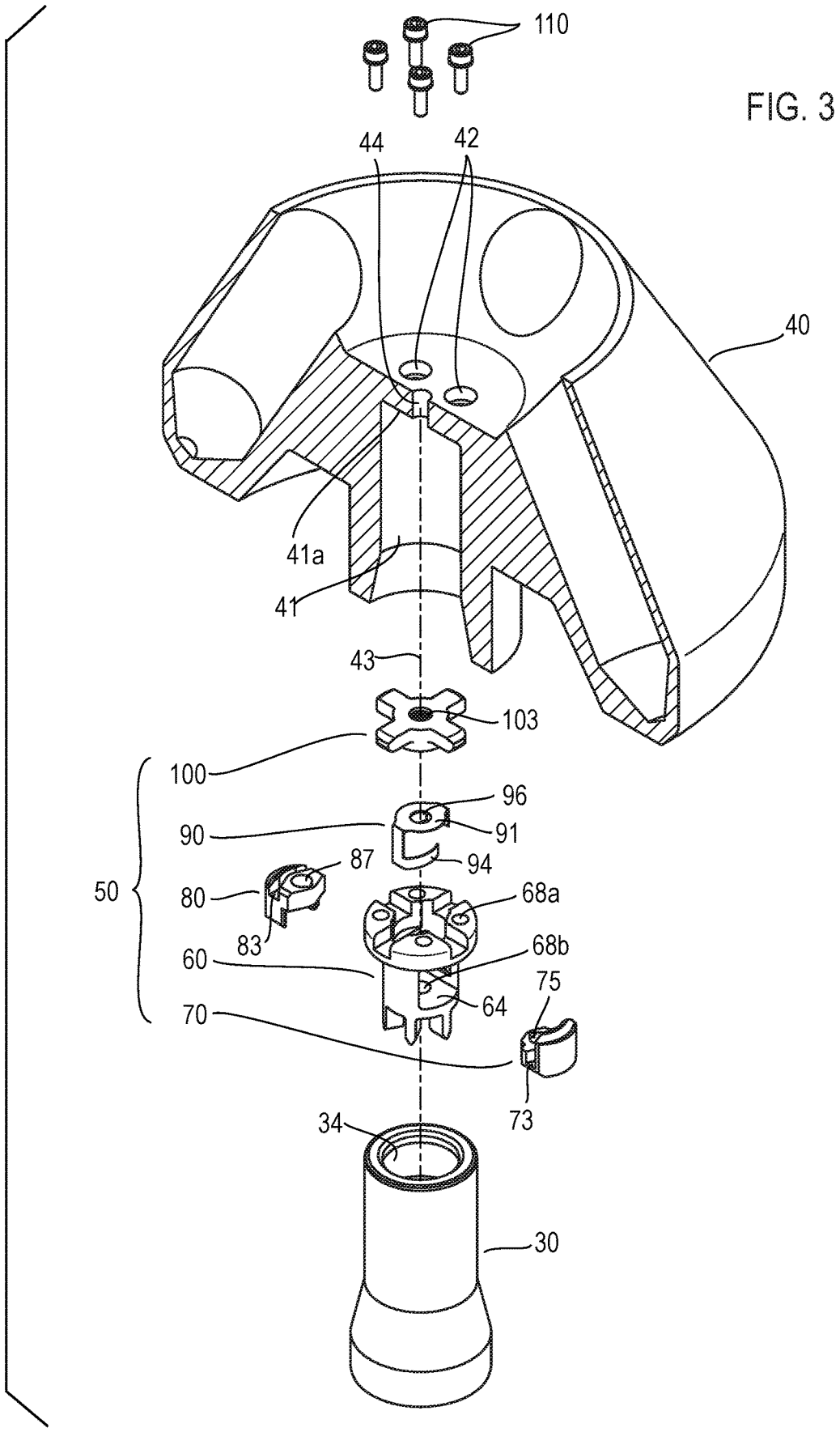
FIG. 3 is an exploded perspective view of the rotor attachment structure shown in FIG. 2, part of which is shown in cross section.
Figure 4A:
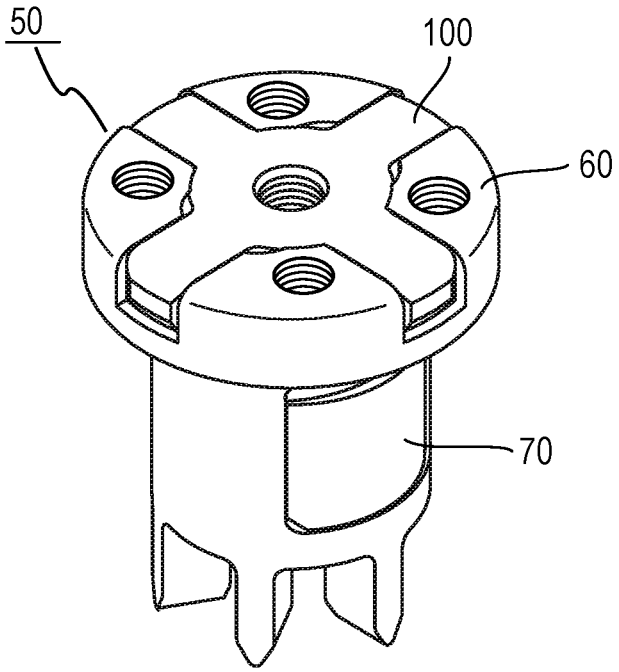
FIG. 4A is a perspective view of an attachment fitting in FIG. 2.
Figure 4B:
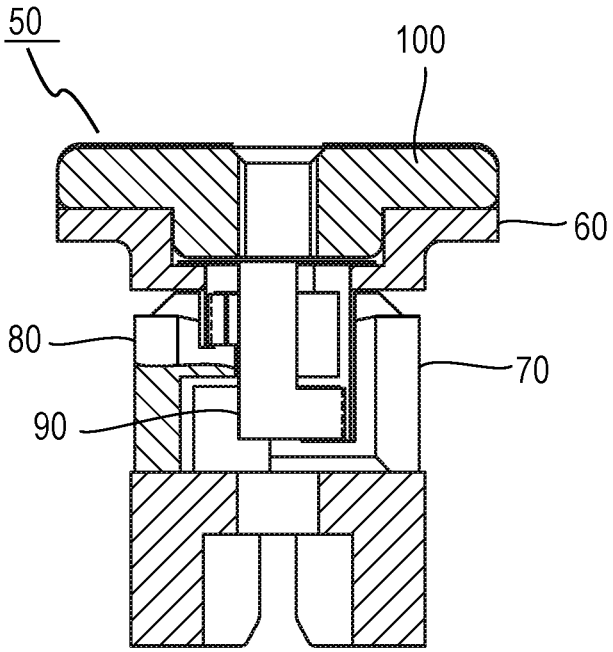
FIG. 4B is a sectional view of the attachment fitting in FIG. 2.

FIG. 3 is an exploded view of individual components of the structure shown in FIG. 2, and the attachment fitting 50 includes, as shown in FIG. 3, a main body 60, a first piece 70, a second piece 80, a leaf spring 90, and a retainer 100. FIGS. 4A and 4B show the attachment fitting 50 constituted as a result of the first and second pieces 70 and 80, the leaf spring 90, and the retainer 100 being incorporated into the main body 60.

First of all, the structure of each component of the shaft 30 and the attachment fitting 50 will be described with reference to the drawings.

Figure 5A:
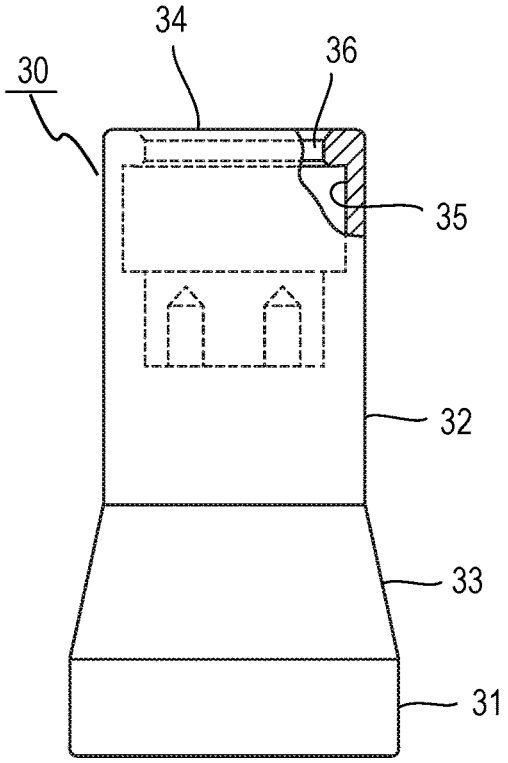
FIG. 5A is a front view of a shaft in FIG. 3, part of which is shown in cross section.
Figure 5B:
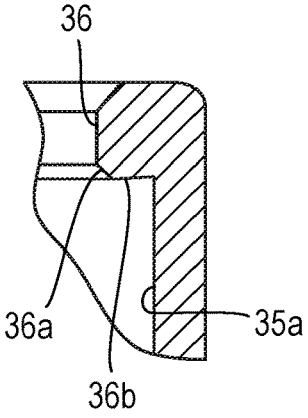
FIG. 5B is an enlarged view of the cross-section part of FIG. 5A.
Figure 5C:
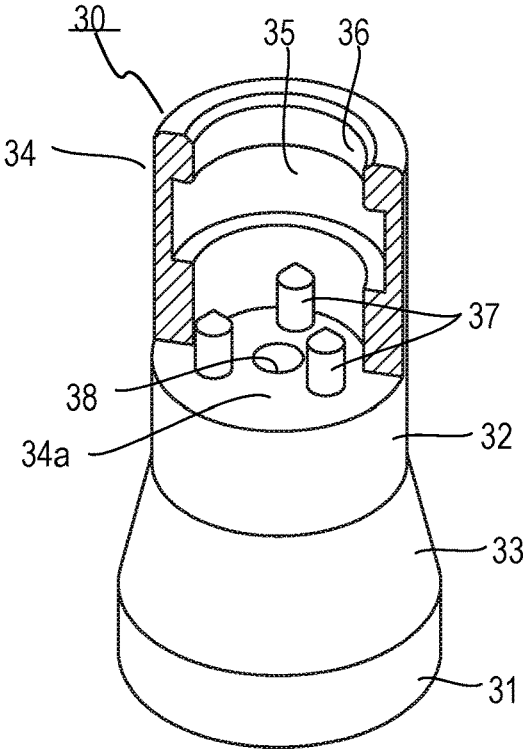
FIG. 5C is a perspective view of the shaft in FIG. 3, part of which is shown in cross section.
Figure 6A:
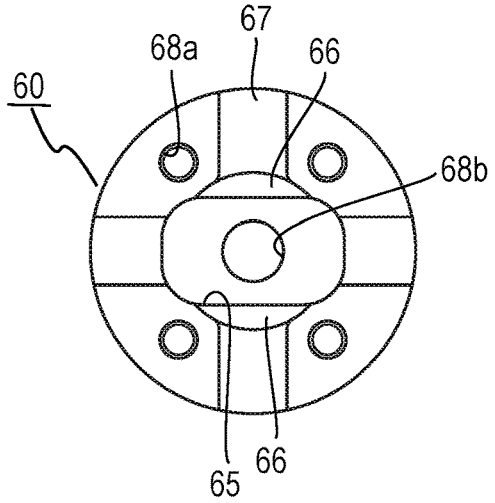
FIG. 6A is a plan view of a main body in FIG. 3.
Figure 6E:
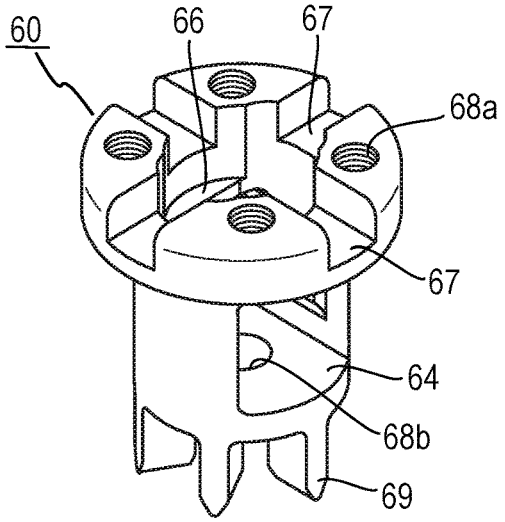
FIG. 6E is a perspective view of the main body in FIG. 3.
Figure 6B:
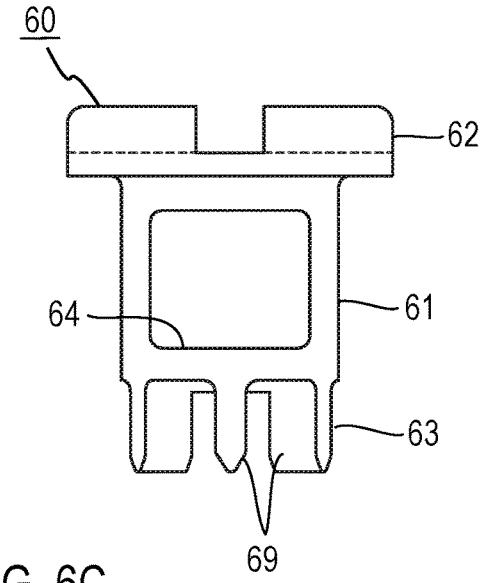
FIG. 6B is a front view of the main body in FIG. 3.
Figure 6D:
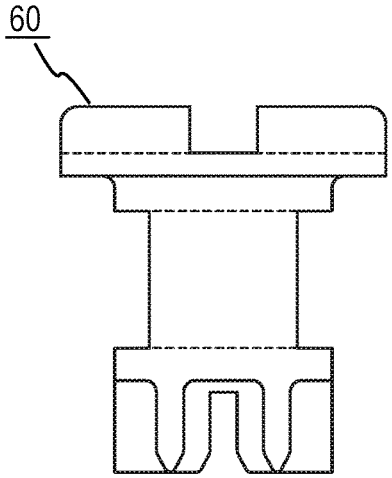
FIG. 6D is a side view of the main body in FIG. 3.
Figure 6C:
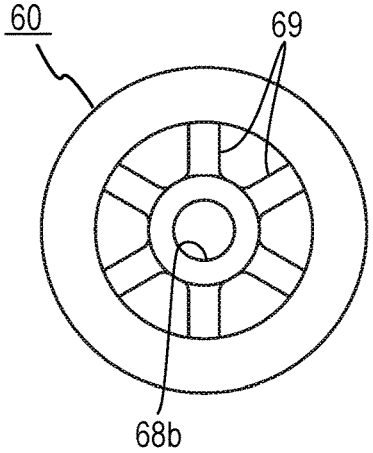
FIG. 6C is a bottom view of the main body in FIG. 3.
Figure 6F:
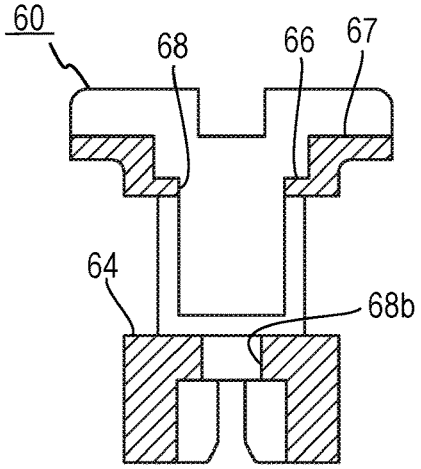
FIG. 6F is a sectional view of the main body in FIG. 3.
Figure 7A:
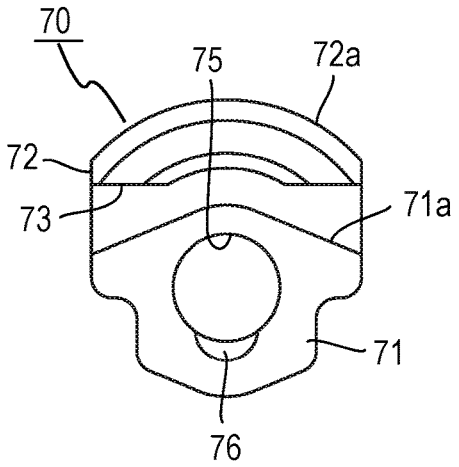
FIG. 7A is a plan view of a first piece in FIG. 3.
Figure 7E:
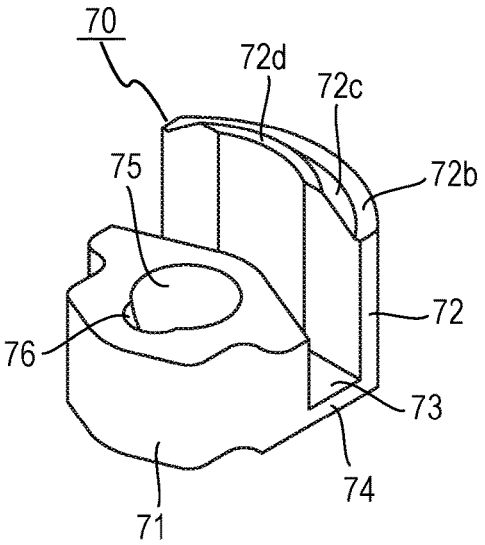
FIG. 7E is a perspective view of the first piece in FIG. 3.
Figure 7B:
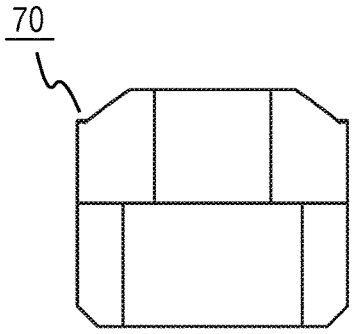
FIG. 7B is a front view of the first piece in FIG. 3.
Figure 7D:
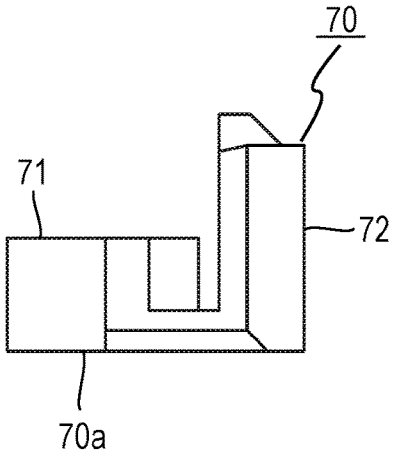
FIG. 7D is a side view of the first piece in FIG. 3.
Figure 7C:
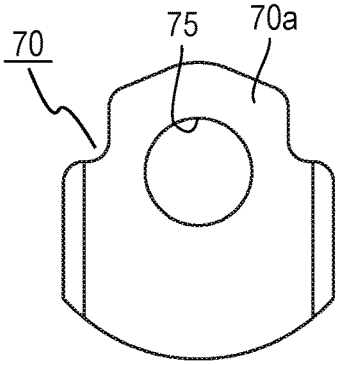
FIG. 7C is a bottom view of the first piece in FIG. 3.
Figure 7F:
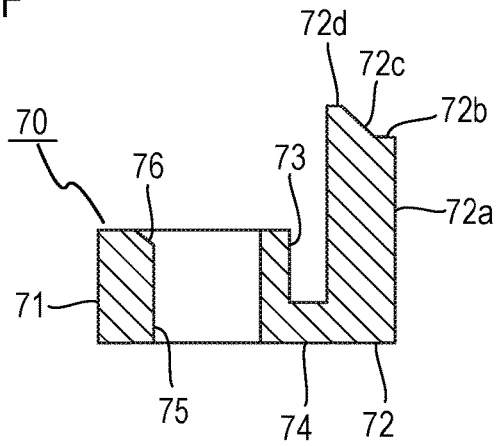
FIG. 7F is a sectional view of the first piece in FIG. 3.
Figure 8A:
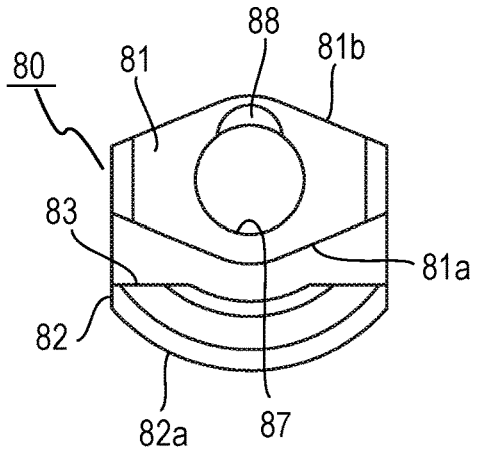
FIG. 8A is a plan view of a second piece in FIG. 3.
Figure 8E:
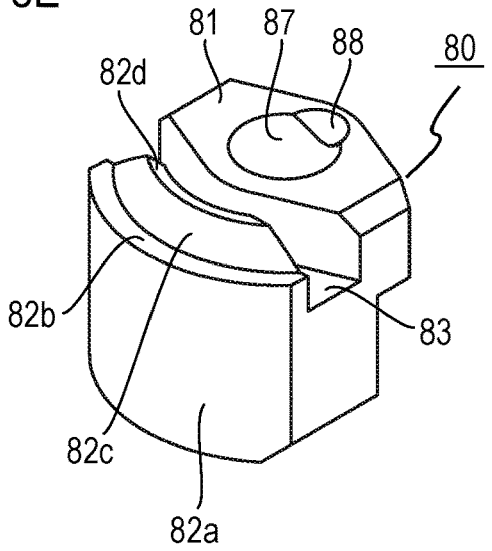
FIG. 8E is a perspective view of the second piece in FIG. 3.
Figure 8B:
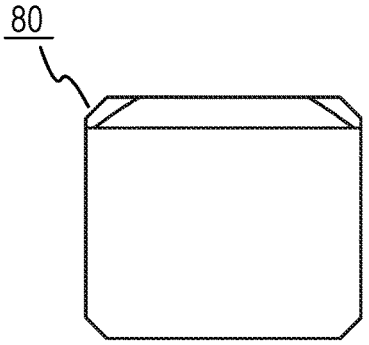
FIG. 8B is a front view of the second piece in FIG. 3.
Figure 8D:
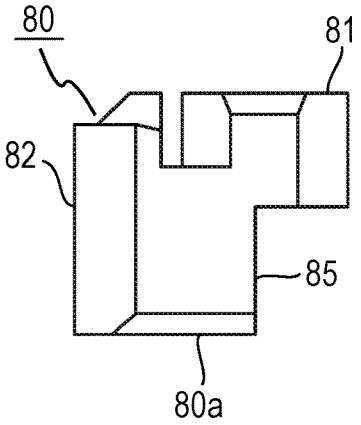
FIG. 8D is a side view of the second piece in FIG. 3.
Figure 8C:
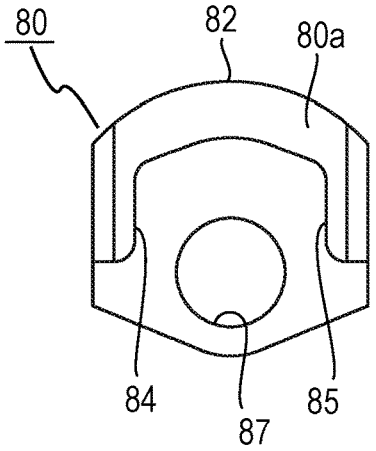
FIG. 8C is a bottom view of the second piece in FIG. 3.
Figure 8F:
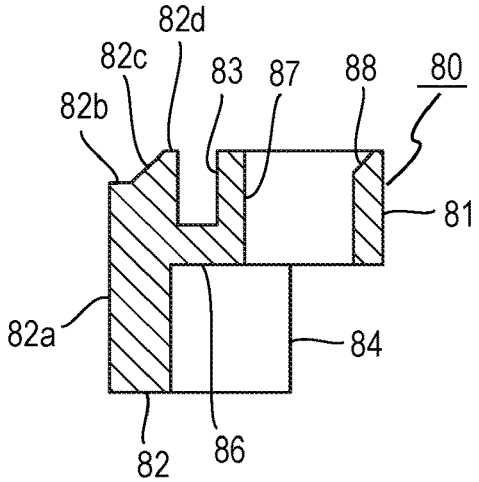
FIG. 8F is a sectional view of the second piece in FIG. 3.

As shown in FIGS. 5A to 5C, the shaft 30 is made up of a large-diameter portion 31, a small-diameter portion 32, and a taper portion 33 that connects these large-diameter portion 31 and small-diameter portion 32, and the tip side of the small-diameter portion 32 is a rotor coupling portion 34 in the shape of a cylinder. In the inner periphery of the rotor coupling portion 34, a ring-shaped depression 35 is formed, and, on the side closer to the tip than the ring-shaped depression 35, a ring-shaped projection 36 projecting from a bottom face 35*a* of the ring-shaped depression 35 is formed. A corner of the ring-shaped projection 36 on the inner periphery thereof on the side where the ring-shaped depression 35 is located is chamfered, and a first shaft inclined surface 36*a* is formed. Moreover, a face from the first shaft inclined surface 36*a* to the bottom face 35*a* of the ring-shaped depression 35 is a second shaft inclined surface 36*b* which forms an acute angle with the bottom face 35*a*.

In an internal bottom face 34*a* of the rotor coupling portion 34, drive pins 37 are provided so as to project therefrom. In this example, three drive pins 37 are provided at equiangular intervals on the circumference of a circle, and the tip of each drive pin 37 has a tapered shape. In the center of the internal bottom face 34*a*, a circular hole 38 that is used to bolt the shaft 30 to the drive shaft of the motor is formed.

The main body 60 of the attachment fitting 50 has a shape shown in FIGS. 6A to 6F and is broadly made up of a circular cylinder portion 61, a flange portion 62 located on the upper-end side of the circular cylinder portion 61, and a drive pin contact portion 63 located on the lower-end side of the circular cylinder portion 61.

In the circular cylinder portion 61, a piece placement hole 64, which is large in size, is formed so as to pass therethrough in a direction orthogonal to the shaft center thereof. The piece placement hole 64 is formed in the shape of a rectangular hole. Above the piece placement hole 64, an opening 65 that communicates with the piece placement hole 64 and opens on the upper side after passing through the circular cylinder portion 61 and the flange portion 62 is formed. The opening 65 is formed in the shape of a rectangle with chamfered corners.

In the upper face of the flange portion 62, on the outside of each of long side portions, which face each other, of the opening 65, a depression 66 is formed as an arc-shaped notch. The arc-shaped contours of the two depressions 66 are located on the circumference of one circle, and the opening 65 is formed so as to cross the circumference of this circle. In addition, in the upper face of the flange portion 62, grooves 67 are formed in the shape of a cross. The grooves 67 are formed from a pair of short side portions of the opening 65 and the two depressions 66 to the outer periphery of the flange portion 62. The depth of the grooves 67 is made smaller than the depth of the depressions 66. Furthermore, in the flange portion 62, four threaded holes 68*a* are formed, and, in the position of the shaft center of the circular cylinder portion 61, a circular hole 68*b* is formed so as to pass therethrough below the piece placement hole 64.

In this example, the drive pin contact portion 63 is made up of six rectangular columns 69 radially disposed at equiangular intervals about the hole 68*b*. Each rectangular column 69 is formed so as to protrude from the lower face of the circular cylinder portion 61, and the tip thereof has a sharp-pointed shape.

The first piece 70 has a shape shown in FIGS. 7A to 7F and has a central part 71 and a side wall portion 72 located on one side of the central part 71, and a groove 73 is provided between the central part 71 and the side wall portion 72. The central part 71 and the side wall portion 72 are coupled together by a coupling portion 74 located below the groove 73.

A side face 71*a* of the central part 71 on the side thereof where the groove 73 is located has a dogleg shape, and, as a result of the width of the central part 71, which is located on the side opposite to the side face 71*a* having a dogleg shape, being reduced so as to be smaller than the width of the side face 71*a*, a bottom face 70*a* of the piece 70 has a substantially convex shape. In the central part 71, a circular hole 75 is formed so as to pass vertically therethrough, and a portion of the hole 75 at the upper-end circumferential edge thereof located on the side opposite to the groove 73 is cut and an inclined surface 76 is formed.

The side wall portion 72 is higher than the central part 71 and an outer side face 72*a* of the side wall portion 72 has the shape of a circular arc. On the upper-end side of the outer side face 72*a* of the side wall portion 72, a second inclined surface 72*b* and a first inclined surface 72*c*, which have the shapes of circular arcs concentric with the shape of a circular arc of the outer side face 72*a*, are formed, and an upper end of the side wall portion 72 leading to the first inclined surface 72*c* is a horizontal surface 72*d*. The shape formed by the first inclined surface 72*c* and the second inclined surface 72*b* is a shape corresponding to the shape formed by the first shaft inclined surface 36*a* and the second shaft inclined surface 36*b* of the shaft 30; that is, the inclination angles of the first inclined surface 72*c* and the second inclined surface 72*b* are made equal to the inclination angles of the first shaft inclined surface 36*a* and the second shaft inclined surface 36*b*. The position of the center of gravity of the piece 70 having the above-described shape is located in a position closer to the side wall portion 72 than the central axis of the hole 75.

The second piece 80 has a shape shown in FIGS. 8A to 8F and has a central part 81 and a side wall portion 82 located on one side of the central part 81, and a groove 83 is provided between the central part 81 and the side wall portion 82. An outer side face 82*a* of the side wall portion 82 has the shape of a circular arc, and a bottom face 80*a* of the piece 80 has the shape of the letter U in which the side wall portion 82 forms an intermediate part of the letter U. Outer wall portions 84 and 85 form leg portions of the letter U, and the central part 81 is located on these outer wall portions 84 and 85 and is separated from the bottom face 80*a* by being supported by the outer wall portions 84 and 85 and a coupling portion 86 located below the groove 83. Since the piece 80 has such a bottom face 80*a* in the shape of the letter U, the piece 80 can stand alone.

As is the case with the side face 71*a* of the central part 71 of the piece 70, a side face 81*a* of the central part 81 on the side thereof where the groove 83 is located and a side face 81*b* of the central part 81 on the opposite side have the shape of a dogleg. In the central part 81, a circular hole 87 is formed so as to pass vertically therethrough, and a portion of the hole 87 at the upper-end circumferential edge thereof located on the side opposite to the groove 83 is cut and an inclined surface 88 is formed.

On the upper-end side of the outer side face 82*a* of the side wall portion 82, a second inclined surface 82*b* and a first inclined surface 82*c*, which have the shapes of circular arcs concentric with the shape of a circular arc of the outer side face 82*a*, are formed, and an upper end of the side wall portion 82 leading to the first inclined surface 82*c* is a horizontal surface 82*d*. The shapes of these horizontal surface 82*d*, first inclined surface 82*c*, and second inclined surface 82*b* are the same as the shapes of the horizontal surface 72*d*, the first inclined surface 72*c*, and the second inclined surface 72*b* of the side wall portion 72 of the piece 70. The height position of the horizontal surface 82*d* is made equal to the height position of the upper face of the central part 81. The position of the center of gravity of the piece 80 is located in a position closer to the side wall portion 82 than the central axis of the hole 87.

Figure 9A:
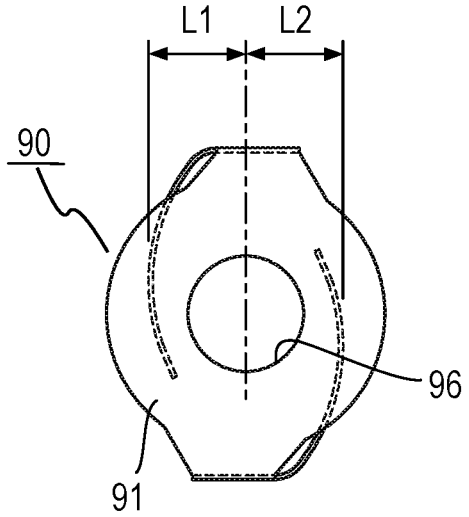
FIG. 9A is a plan view of a leaf spring in FIG. 3.
Figure 9C:
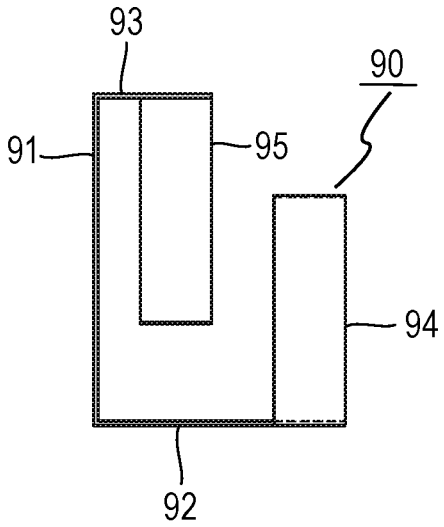
FIG. 9C is a bottom view of the leaf spring in FIG. 3.
Figure 9B:
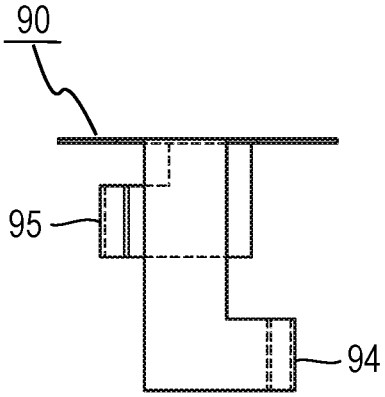
FIG. 9B is a front view of the leaf spring in FIG. 3.
Figure 9D:
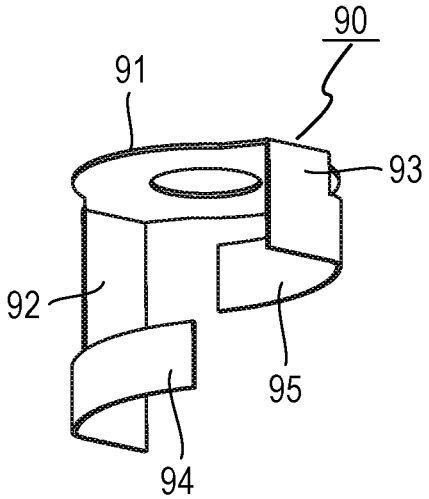
FIG. 9D is a perspective view of the leaf spring in FIG. 3.

The leaf spring 90 has a shape shown in FIGS. 9A to 9D and is made up of a base 91 having a substantially elliptical shape, two long and short extension portions 92 and 93 which are formed by being bent 90 degrees from both ends of the base 91 in the same direction, and two arm portions 94 and 95 formed so as to extend from the tips of the extension portions 92 and 93 in the direction of the width of the extension portions 92 and 93. In the center of the base 91, a circular hole 96 is formed. The two arm portions 94 and 95 are formed in the shape of a circular arc so as to surround the central axis of the hole 96, the two arm portions 94 and 95 are made to have the same width and length, and the distances L1 and L2 from the central axis of the hole 96 shown in FIG. 9A are also made equal to each other.

Figure 10A:
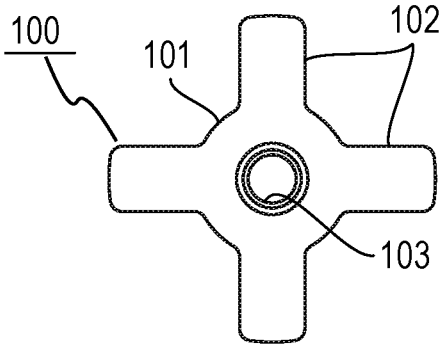
FIG. 10A is a plan view of a retainer in FIG. 3.
Figure 10B:
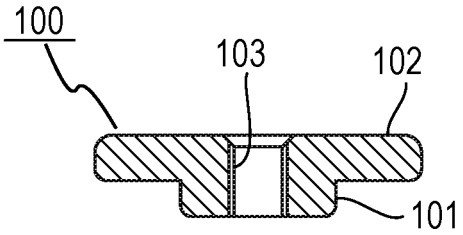
FIG. 10B is a sectional view of the retainer in FIG. 3.
Figure 10C:
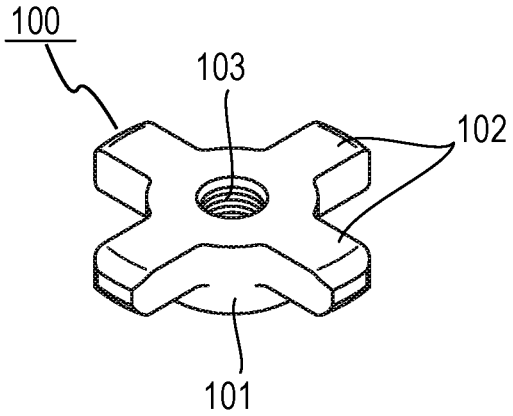
FIG. 10C is a perspective view of the retainer in FIG. 3.

The retainer 100 has a shape shown in FIGS. 10A to 10C and is made up of a circular cylinder portion 101 and four protrusions 102 protruding from the periphery of the circular cylinder portion 101 on the upper-end side thereof so as to form the shape of a cross. In the center of the circular cylinder portion 101, a threaded hole 103 is formed.

Figure 11:
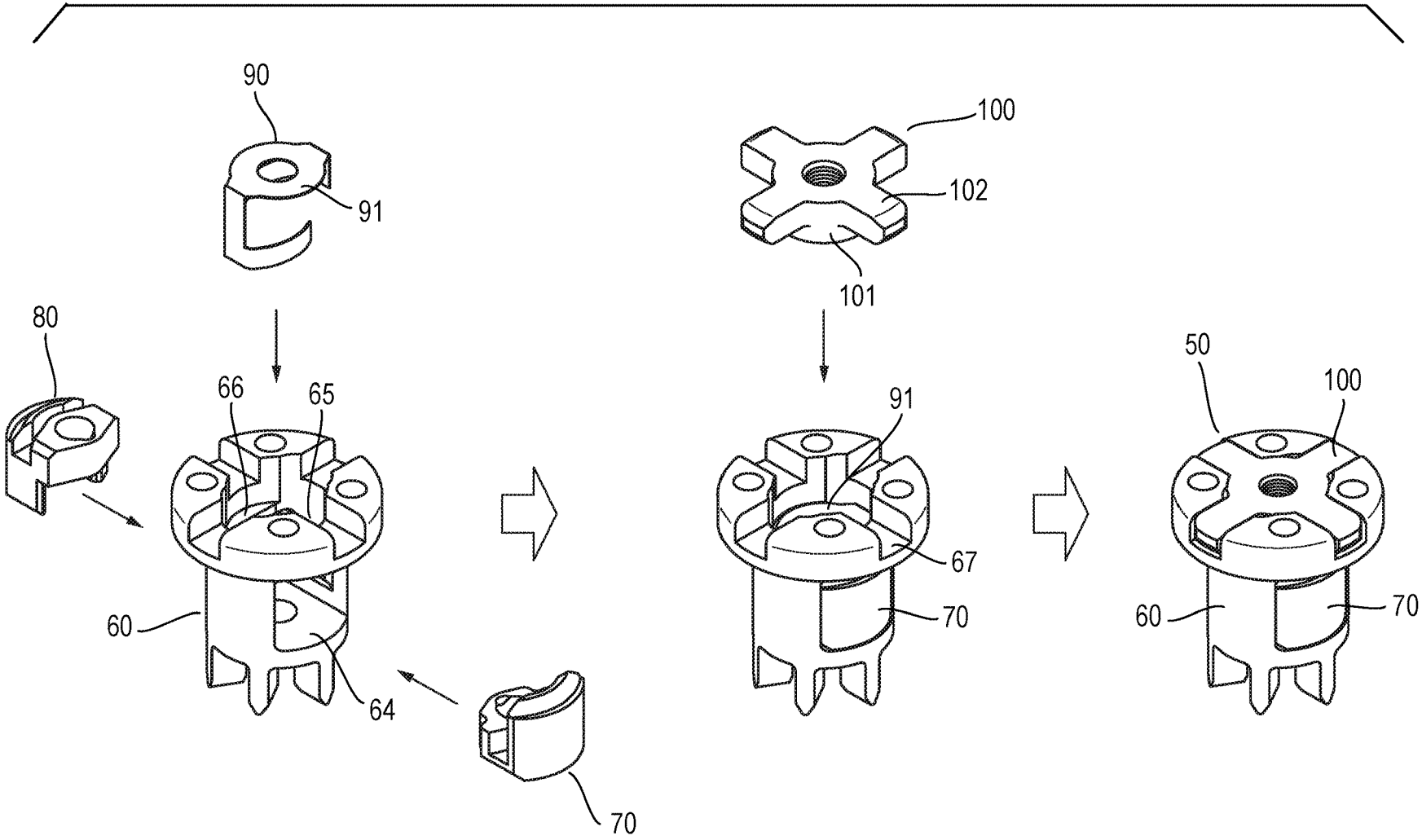
FIG. 11 is a diagram for explaining an assembly procedure of the attachment fitting shown in FIG. 4A.

FIG. 11 shows assembly of the individual components that constitute the attachment fitting 50, and the piece 70 and the piece 80 are disposed by being inserted into the piece placement hole 64 of the main body 60. As for the leaf spring 90, the extension portions 92 and 93 and the arm portions 94 and 95 are inserted into the piece placement hole 64 via the opening 65, and the base 91 is fitted into the depressions 66 of the main body 60. Finally, the retainer 100 is mounted on the main body 60. The circular cylinder portion 101 of the retainer 100 is fitted into the depressions 66 and the protrusions 102 in the shape of a cross are fitted into the groove 67 of the main body 60. The pieces 70 and 80, the leaf spring 90, and the retainer 100 are incorporated into the main body 60 in this way, which completes the attachment fitting 50.

Figure 12A:
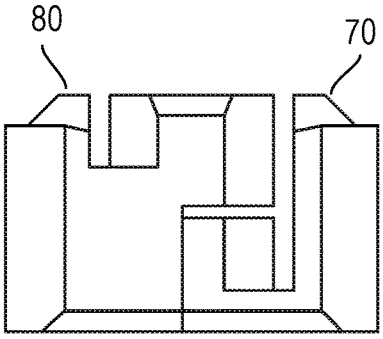
FIG. 12A is a front view showing the positional relationship between the first piece and the second piece in the attachment fitting.
Figure 12C:
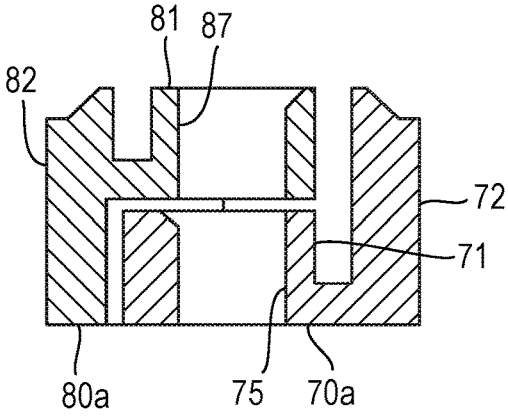
FIG. 12C is a sectional view showing the positional relationship between the first piece and the second piece in the attachment fitting.
Figure 12B:
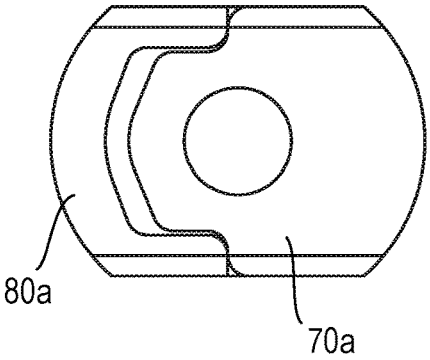
FIG. 12B is a bottom view showing the positional relationship between the first piece and the second piece in the attachment fitting.
Figure 12D:
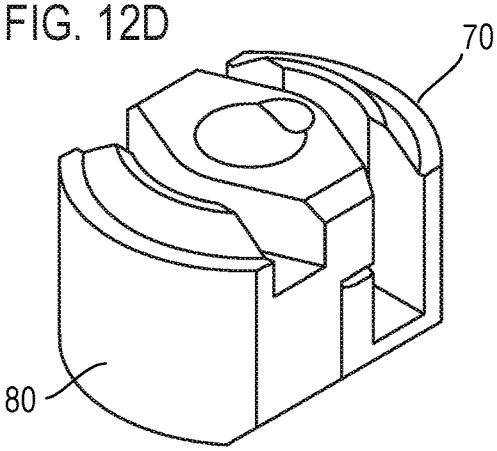
FIG. 12D is a perspective view showing the positional relationship between the first piece and the second piece in the attachment fitting.

FIGS. 12A to 12D show the relationship between the piece 70 and the piece 80 incorporated into the main body 60, the central part 81 of the piece 80 is located on the central part 71 of the piece 70 and overlaps therewith, and the side wall portion 72 of the piece 70 and the side wall portion 82 of the piece 80 are located on the sides opposite to each other with a portion, in which the central parts 71 and 81 overlap one another, being placed therebetween. Moreover, a projection portion (part of the central part 71) of the bottom face 70*a* with a substantially convex shape of the piece 70 enters a letter U of the U-shaped bottom face 80*a* of the piece 80. As shown in FIG. 12A, the piece 70 and the piece 80 are made equal in height.

Figure 13:
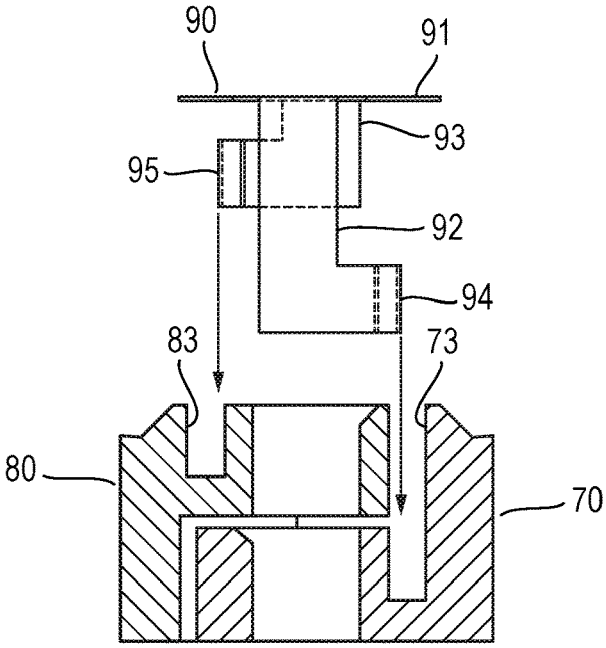
FIG. 13 is a diagram for explaining incorporation of the leaf spring into the first piece and the second piece.

FIG. 13 shows how the leaf spring 90 is incorporated, the arm portion 94 formed in the long extension portion 92 of the leaf spring 90 is inserted into the groove 73 of the piece 70, and the arm portion 95 formed in the short extension portion 93 is inserted into the groove 83 of the piece 80.

Figure 14C:
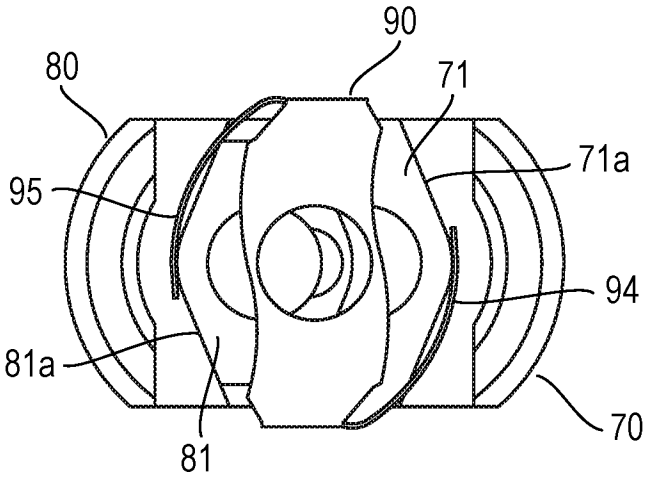
FIG. 14C is a plan view showing the state of the first and second pieces and the leaf spring at the time of rotation.
Figure 14D:
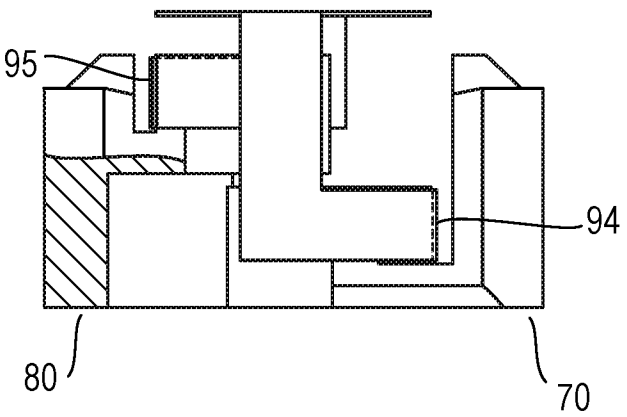
FIG. 14D is a plan view showing the state of the first and second pieces and the leaf spring, part of which is shown in cross section, at the time of rotation.
Figure 14A:
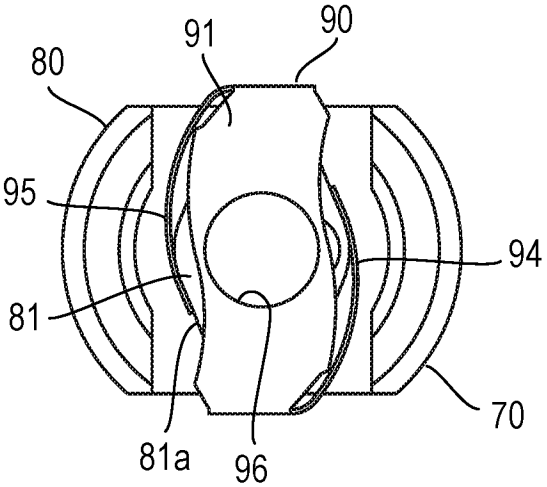
FIG. 14A is a plan view showing the state of the first and second pieces and the leaf spring when rotation is stopped.
Figure 14B:
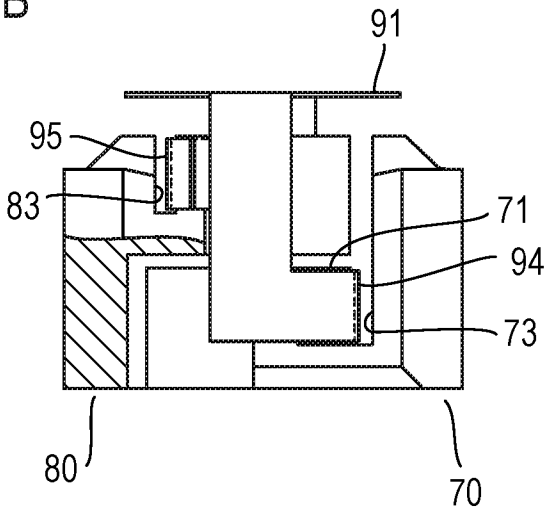
FIG. 14B is a front view showing the state of the first and second pieces and the leaf spring, part of which is shown in cross section, when rotation is stopped.

FIGS. 14A and 14B show the relationship between the pieces 70 and 80 and the leaf spring 90, showing part of the base 91 of the leaf spring 90 in a cutaway view. The arm portions 94 and 95 are in contact with the side face 71*a* of the central part 71 of the piece 70 and the side face 81*a* of the central part 81 of the piece 80, respectively, and the piece 70 and the piece 80 are positioned by the arm portions 94 and 95, respectively, that is, held by the arm portions 94 and 95 in predetermined positions in the piece placement hole 64 of the main body 60.

The attachment fitting 50 is attached to the rotor 40. The rotor 40 has, as shown in FIGS. 2 and 3, a rotor hole 41 into which the shaft 30 is inserted, and the attachment fitting 50 is attached inside this rotor hole 41. Attachment is performed by using four bolts 110 (see FIG. 3), and, as a result of the four bolts 110 being screwed into the threaded holes 68*a* formed in the main body 60 of the attachment fitting 50 through holes 42 formed in a bottom face 41*a* of the rotor hole 41, the attachment fitting 50 is screw-held to the bottom face 41*a* of the rotor hole 41.

As a result of the main body 60 being screw-held to the bottom face 41*a* of the rotor hole 41 in this way, the base 91 of the leaf spring 90 and the retainer 100 are fixed by being put between the bottom face 41*a* of the rotor hole 41 and the main body 60. In a state in which the attachment fitting 50 is attached to the rotor 40, the holes 96, 75, 87, and 68*b* which are formed in the base 91 of the leaf spring 90, the central part 71 of the piece 70, the central part 81 of the piece 80, and the main body 60, respectively, are located on a rotation central axis 43 of the rotor 40 and the threaded hole 103 of the retainer 100 is also located on the rotation central axis 43. In the bottom face 41*a* of the rotor hole 41, a circular hole 44 is formed so as to be located on the rotation central axis 43.

The rotor 40 provided with the attachment fitting 50 is attached to the shaft 30 as shown in FIG. 2. In this example, the rotor 40 is an angle rotor and includes a plurality of container holes 45 which house and hold containers containing samples. The rotor hole 41 has a shape corresponding with the small-diameter portion 32 and the taper portion 33 of the shaft 30, and an opening side (a lower-end side) thereof is formed of a taper face 41*b* which gradually increases in diameter toward an opening. The taper portion 33 of the shaft 30 is a holding surface that holds the rotor 40, and, as a result of the taper face 41*b* being placed on the taper portion 33, the rotor 40 is attached to the shaft 30.

Figure 15D:
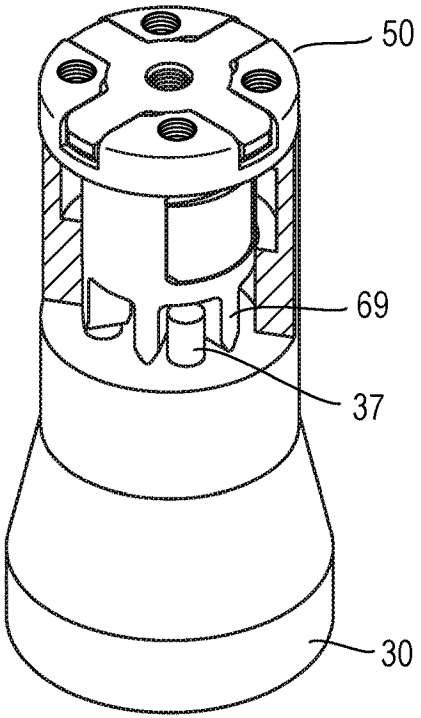
FIG. 15D is a diagram showing the state in which the attachment fitting is housed in the rotor coupling portion of the shaft in attachment of the rotor to the shaft.
Figure 15E:
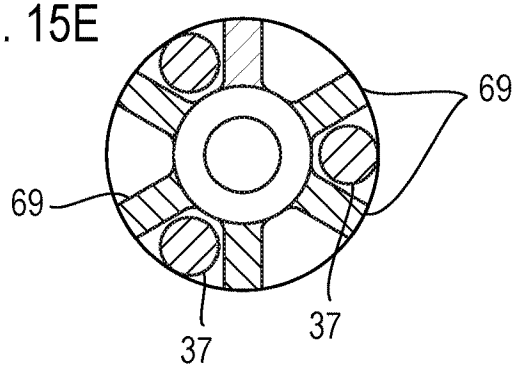
FIG. 15E is a diagram showing the state in which the attachment fitting is housed in the rotor coupling portion of the shaft in attachment of the rotor to the shaft.
Figure 15B:
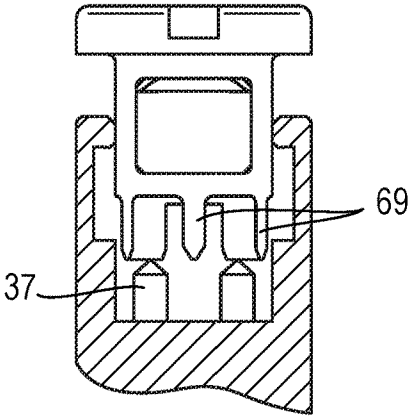
FIG. 15B is a diagram showing how the attachment fitting is inserted into the rotor coupling portion of the shaft in attachment of the rotor to the shaft.
Figure 15C:
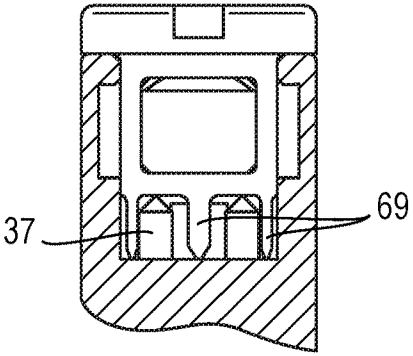
FIG. 15C is a diagram showing the state in which the attachment fitting is housed in the rotor coupling portion of the shaft in attachment of the rotor to the shaft.
Figure 15A:
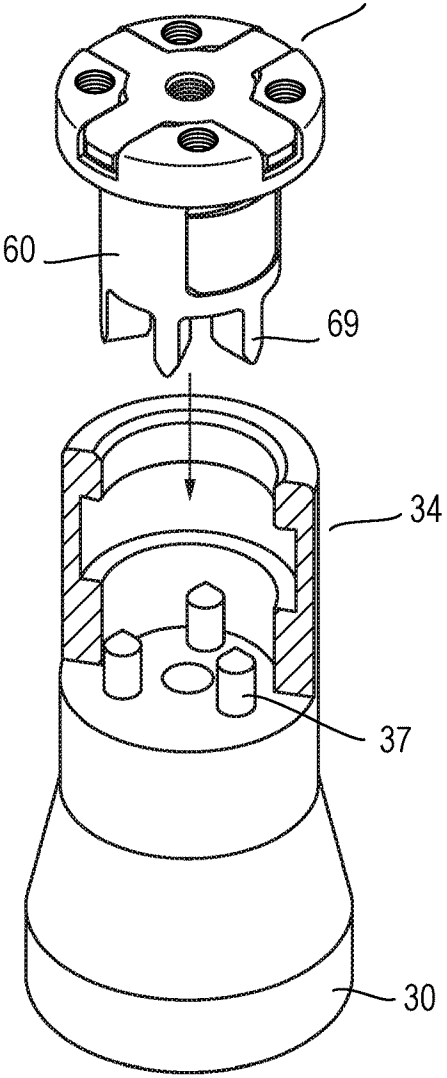
FIG. 15A is a diagram showing how the attachment fitting is inserted into a rotor coupling portion of the shaft in attachment of the rotor to the shaft.

FIGS. 15A to 15E show a state in which, in attachment of the rotor 40 to the shaft 30, the attachment fitting 50 attached to the rotor 40 is inserted into and housed in the rotor coupling portion 34 of the shaft 30, and, since the six rectangular columns 69 formed in the lower part of the main body 60 of the attachment fitting 50 each have a sharp-pointed shape and the three drive pins 37 provided in the rotor coupling portion 34 so as to project therefrom each have a tapered shape, even when the rectangular columns 69 and the drive pins 37 come into contact with each other as shown in FIG. 15B, the rectangular columns 69 are guided into spaces between the drive pins 37 as shown in FIG. 15C. As a result, the three drive pins 37 are disposed in alternate spaces between the adjacent rectangular columns 69 as shown in FIGS. 15D and 15E, and bodies of the drive pins 37 and the rectangular columns 69 are in contact with each other. When the shaft 30 rotates, the rectangular columns 69 receive power from the drive pins 37, which makes it possible to rotate the rotor 40.

Figure 16B:
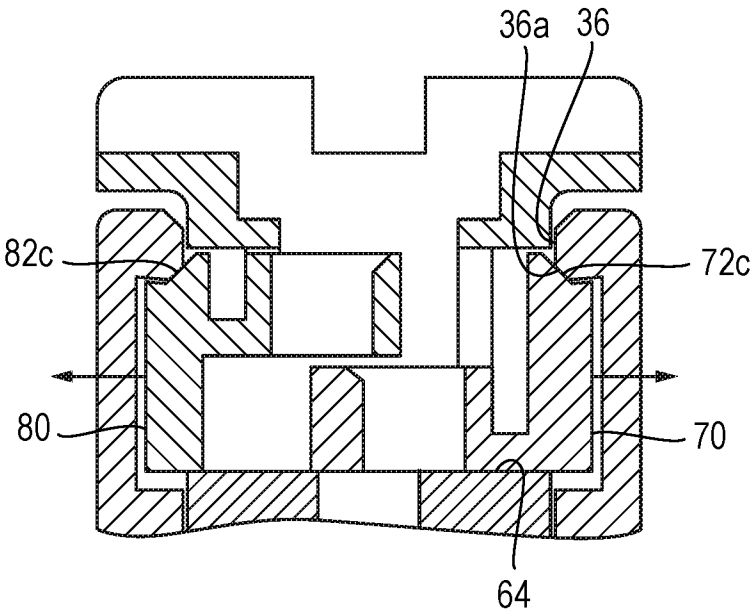
FIG. 16B is a sectional view showing the relationship between the first and second pieces and the rotor coupling portion at the time of rotation.
Figure 16A:
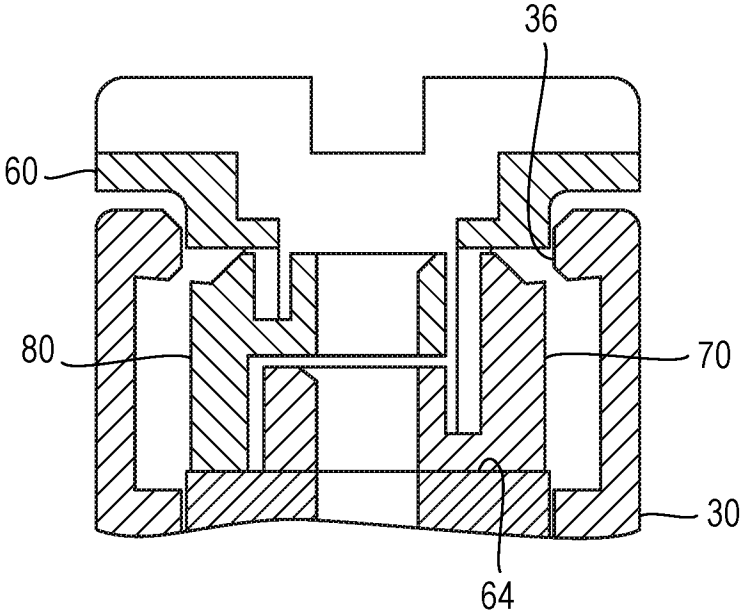
FIG. 16A is a sectional view showing the relationship between the first and second pieces and the rotor coupling portion when rotation is stopped.

In a state in which the rotation of the rotor 40 is stopped, the pieces 70 and 80 are located in the piece placement hole 64 of the main body 60, and, as shown in FIG. 16A, the pieces 70 and 80 and the ring-shaped projection 36 of the shaft 30 are separated from each other. When the rotor 40 rotates by the rotation of the shaft 30, the pieces 70 and 80 move in opposite directions in the piece placement hole 64 by the centrifugal force against the spring force of the leaf spring 90, and the pieces 70 and 80 protrude from one end and the other end of the piece placement hole 64 as shown in FIG. 16B. Then, the first inclined surfaces 72*c* and 82*c* of the pieces 70 and 80 make contact with the first shaft inclined surface 36*a* of the ring-shaped projection 36 of the shaft 30. As described above, as a result of the first inclined surfaces 72*c* and 82*c* of the pieces 70 and 80 making contact with the first shaft inclined surface 36*a*, fastening power of the rotor 40 and the shaft 30 is generated. FIGS. 14C and 14D show the relationship between the pieces 70 and 80 and the leaf spring 90 in the above situation, and the arm portions 94 and 95 of the leaf spring 90 are widely opened.

Figure 17B:
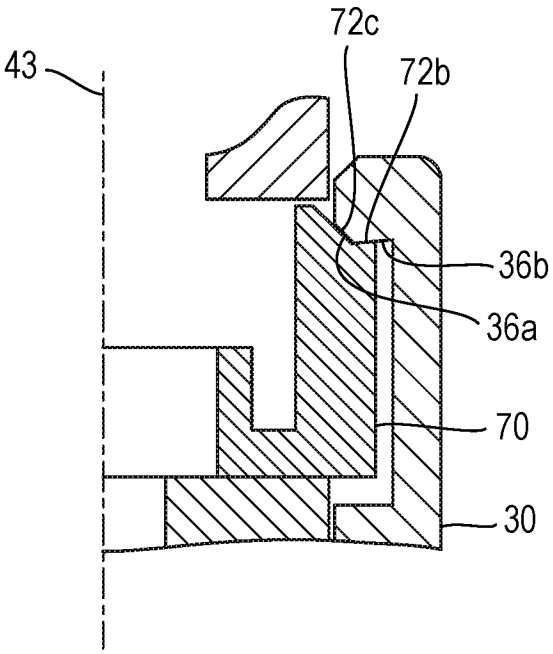
FIG. 17B is a sectional view showing the state in which a second inclined surface of the first piece and a second shaft inclined surface are in contact with each other.
Figure 17A:
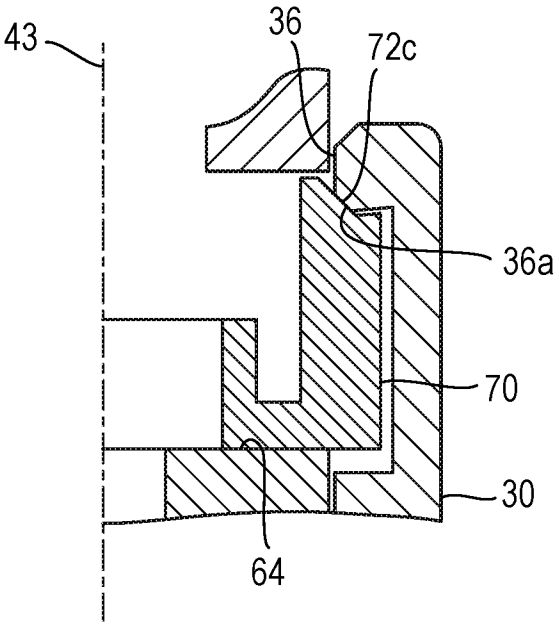
FIG. 17A is a sectional view showing the state in which a first inclined surface of the first piece and a first shaft inclined surface are in contact with each other.

FIGS. 17A and 17B show two modes, on the side of the piece 70, of a contact state between the pieces 70 and 80 and the ring-shaped projection 36 of the shaft 30; FIG. 17A shows a state in which the first inclined surface 72*c* of the piece 70 is in contact with the first shaft inclined surface 36*a* by being pressed against the first shaft inclined surface 36*a* and FIG. 17B shows a state in which the first inclined surface 72*c* and the second inclined surface 72*b* of the piece 70 are in contact with the first shaft inclined surface 36*a* and the second shaft inclined surface 36*b*, respectively. FIG. 17B shows a case in which a force that causes the rotor 40 to rise, the force exceeding the fastening power of the rotor 40 and the shaft 30 generated by the contact state of FIG. 17A, is generated in the rotor 40 by vibrations or the like, and, if such a force that causes the rotor 40 to rise is generated in the rotor 40, as a result of the second inclined surfaces 72*b* and 82*b* of the pieces 70 and 80 and the second shaft inclined surface 36*b* making contact with each other, rise of the rotor 40 can be prevented, that is, the rotor 40 is prevented from rising to a certain height or higher. As described earlier, since the pieces 70 and 80 have the first inclined surfaces 72*c* and 82*c* with the same shape and the second inclined surfaces 72*b* and 82*b* with the same shape, which constitute a contact portion, the contact pressures between the first inclined surfaces 72*c* and 82*c* and the first shaft inclined surface 36*a* are equal to each other and the contact pressures between the second inclined surfaces 72*b* and 82*b* and the second shaft inclined surface 36*b* are equal to each other.

Figure 18A:
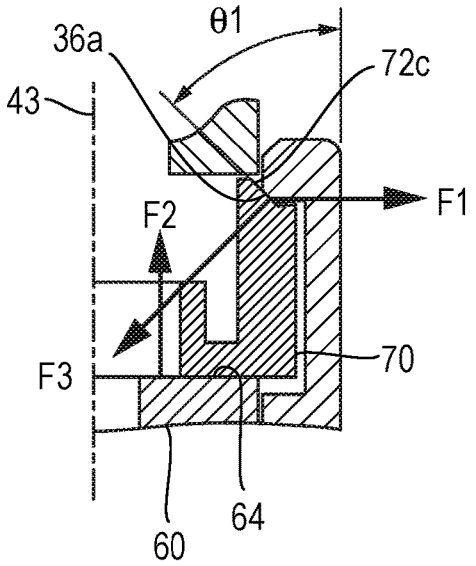
FIG. 18A is a diagram for explaining forces which are generated in a state in which the first inclined surface of the first piece and the first shaft inclined surface are in contact with each other.
Figure 18B:
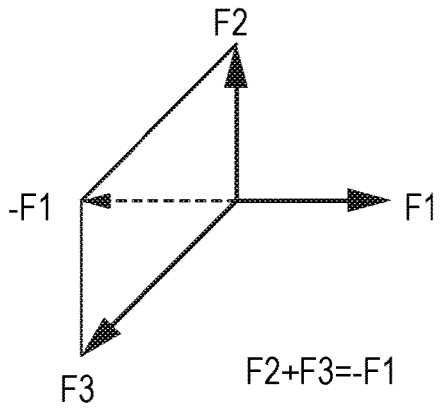
FIG. 18B is a diagram showing a balance among the forces shown in FIG. 18A.

FIGS. 18A and 18B show forces which are generated in the state shown in FIG. 17A, and a force F1, a force F3, and a force F2 are balanced, the force F1 which the piece 70 receives due to the centrifugal force, the force F3 which the piece 70 receives from the first shaft inclined surface 36*a* in the direction of the normal to the first shaft inclined surface 36*a*, and the force F2 which the piece 70 receives from the surface forming the piece placement hole 64 of the main body 60 in the direction of the normal to the surface. Thus, the shaft 30 and the rotor 40 are fastened together. An angle θ1 which the first inclined surface 72*c* of the piece 70 forms with the vertical direction only has to be 20 degrees or more but 70 degrees or less; preferably, the angle θ1 is 30 degrees or more but 60 degrees or less and, more preferably, 40 degrees or more but 50 degrees or less. The same goes for the angle of the first inclined surface 82*c* of the piece 80.

Figure 19A:
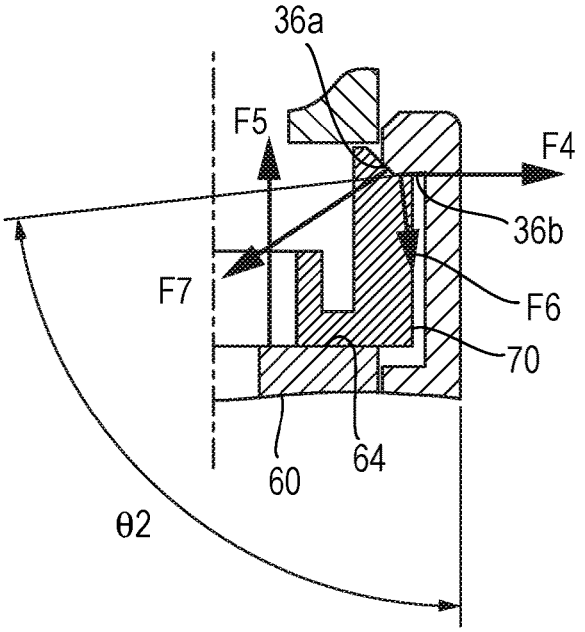
FIG. 19A is a diagram for explaining forces which are generated in a state in which the first and second inclined surfaces of the first piece and the first and second shaft inclined surfaces are in contact with each other.
Figure 19B:
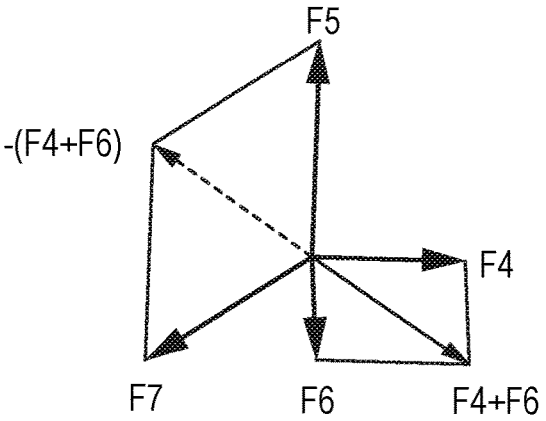
FIG. 19B is a diagram showing a balance among the forces shown in FIG. 19A.

FIGS. 19A and 19B show forces which are generated in the state shown in FIG. 17B, and a force F4, a force F5, a force F6, and a force F7 are balanced, the force F4 which the piece 70 receives due to the centrifugal force, the force F5 which the piece 70 receives from the surface forming the piece placement hole 64 of the main body 60 in the direction of the normal to the surface, the force F6 which the piece 70 receives from the second shaft inclined surface 36*b* in the direction of the normal to the second shaft inclined surface 36*b*, and the force F7 which the piece 70 receives from the first shaft inclined surface 36*a* in the direction of the normal to the first shaft inclined surface 36*a*. Thus, the rotor 40 does not rise. An angle θ2 which the second inclined surface 72*b* of the piece 70 forms with the vertical direction only has to be 90 degrees or less.

When the rotation of the rotor 40 is stopped, generation of the centrifugal force is stopped and the arm portions 94 and 95 of the leaf spring 90 restore to the initial state shown in FIGS. 14A and 14B from the state shown in FIGS. 14C and 14D by an elastic restoring force. As a result, the pieces 70 and 80 return to the initial positions, that is, are housed in the piece placement hole 64.

After the rotation of the rotor 40 is stopped, sometimes the pieces 70 and 80 do not return to the initial positions and enter a locked state in which the pieces 70 and 80 remain in contact with the second shaft inclined surface 36*b* as shown in FIG. 17B, for example. Such a locked state can be caused, for example, as a result of the pieces 70 and 80 sticking to the shaft 30 with the leaked sample or the like or by a breakage or the like of the leaf spring 90.

In this example, even when such a locked state is caused, this locked state can be released easily. FIGS. 20A to 20D show how to release the locked state, and a tool 120 is used to return the pieces 70 and 80 to the initial positions in the piece placement hole 64. The tool 120 is made up of a grasping portion 121 and a shaft portion 122; in this example, a screw 122*a* is formed in the shaft portion 122. Moreover, the tip of the shaft portion 122 has a tapered shape.

Figure 20A:
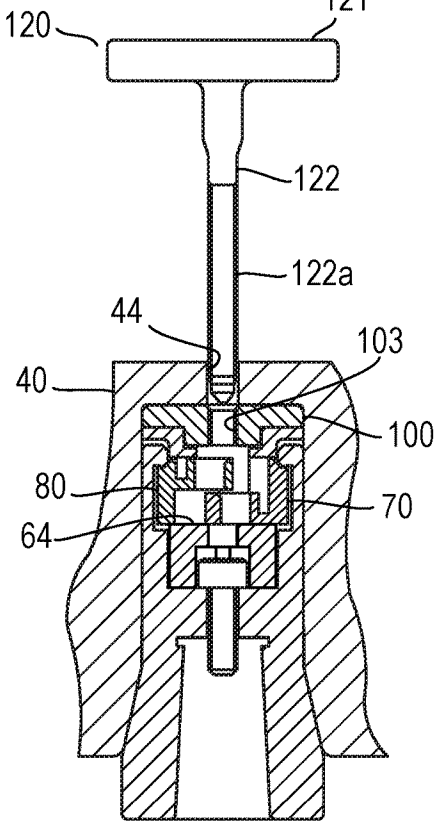
FIG. 20A is a diagram for explaining release of a locked state of the shaft and the rotor which is caused as a result of the first and second pieces not having returned.
Figure 20B:
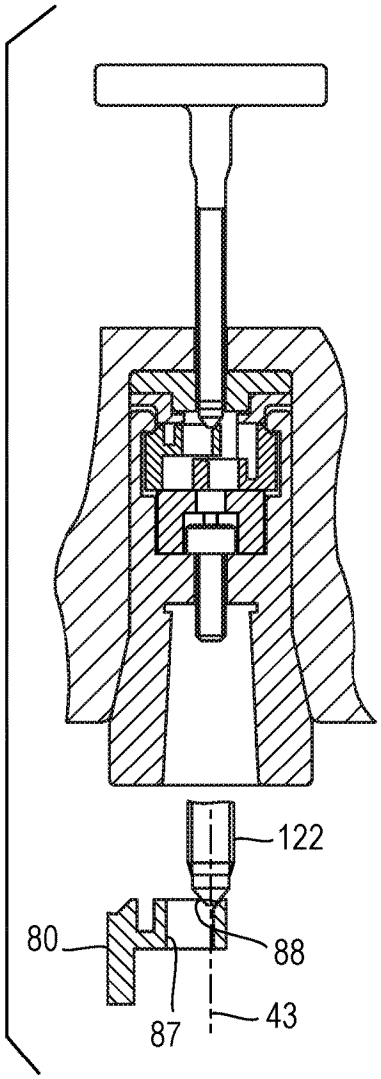
FIG. 20B is a diagram for explaining release of a locked state of the shaft and the rotor which is caused as a result of the first and second pieces not having returned.
Figure 20C:
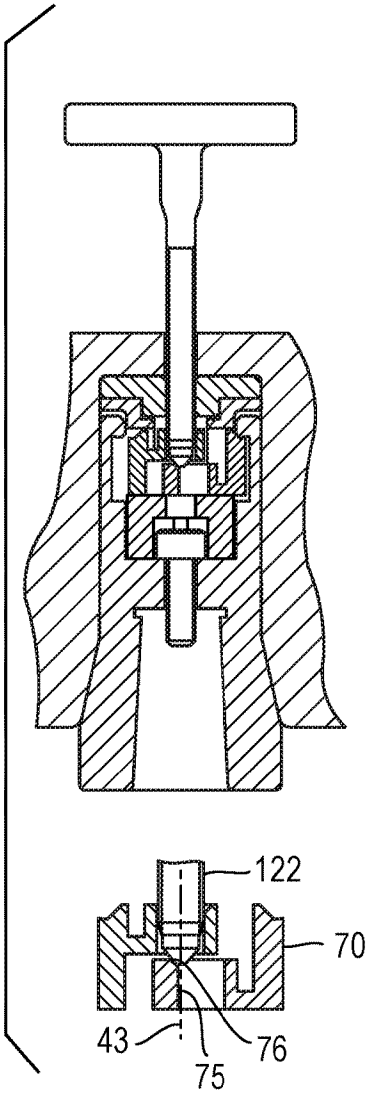
FIG. 20C is a diagram for explaining release of a locked state of the shaft and the rotor which is caused as a result of the first and second pieces not having returned.
Figure 20D:
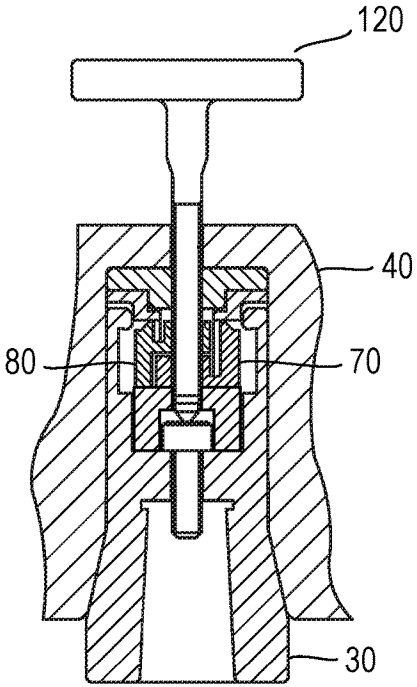
FIG. 20D is a diagram for explaining release of a locked state of the shaft and the rotor which is caused as a result of the first and second pieces not having returned.

As shown in FIG. 20A, when the shaft portion 122 of the tool 120 is inserted into the hole 44 of the rotor 40 and screwed into the threaded hole 103 of the retainer 100 by turning the tool 120, the tip of the shaft portion 122 presses the inclined surface 88 at the circumferential edge of the hole 87 of the piece 80 as shown in FIG. 20B, which makes it possible to move the piece 80 to the side where the rotation central axis 43 is located. When the shaft portion 122 is further inserted, the tip of the shaft portion 122 presses the inclined surface 76 at the circumferential edge of the hole 75 of the piece 70 as shown in FIG. 20C, which makes it possible to move the piece 70 to the side where the rotation central axis 43 is located as in the case of the piece 80. As a result, the state enters a state shown in FIG. 20D, and it is possible to release the locked state of the shaft 30 and the rotor 40 and detach the rotor 40 from the shaft 30. Since the tip of the shaft portion 122 has a tapered shape and the pieces 80 and 70 have formed therein the inclined surfaces 88 and 76, respectively, for guiding the shaft portion 122 into the holes 87 and 75, the shaft portion 122 is easily guided into the holes 87 and 75. As described above, in this example, by one motion of inserting the tool 120, it is possible to move the two pieces 70 and 80 and release the locked state.

Figure 21B:
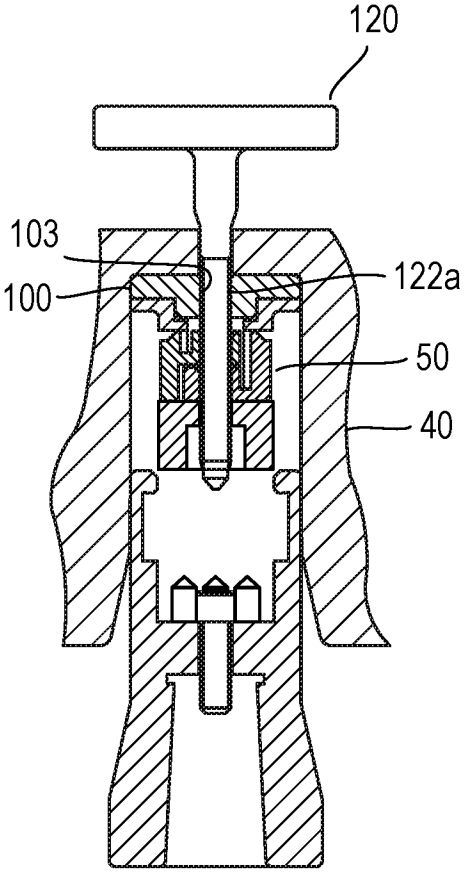
FIG. 21B is a diagram for explaining release which is performed if the shaft and the rotor hole stick to each other.
Figure 21A:
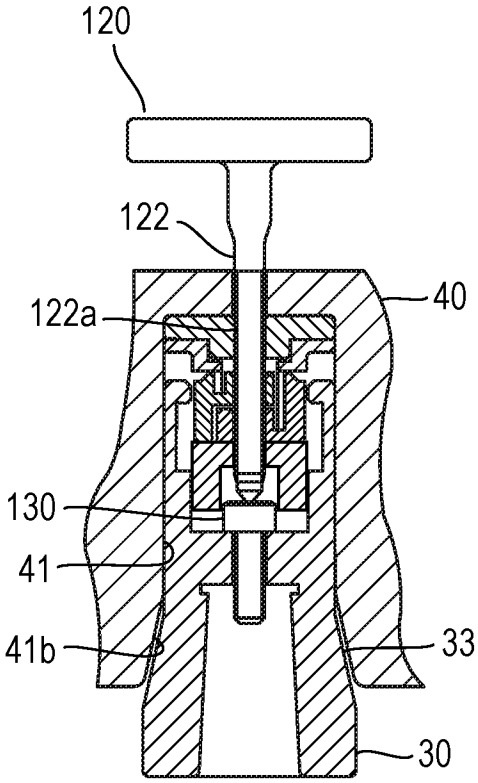
FIG. 21A is a diagram for explaining release which is performed if the shaft and a rotor hole stick to each other.

On the other hand, FIGS. 21A and 21B show release which is performed when the taper face 41*b* of the rotor hole 41 and the taper portion 33 of the shaft 30, which forms the holding surface that holds the rotor 40, stick to each other, for example. When the tool 120 is turned and screwed as in the case of the above-described release of lock, the tip of the shaft portion 122 comes into contact with a bolt 130 that holds the shaft 30 to the drive shaft of the motor, and, by further turning the tool 120 and pressing the shaft portion 122 against the bolt 130, it is possible to cause the rotor 40 to rise as shown in FIG. 21A, which makes it possible to release sticking. Since the screw 122*a* of the tool 120 threadedly engages the threaded hole 103 of the retainer 100 of the attachment fitting 50 attached to the rotor 40, by lifting the tool 120, it is possible to lift the rotor 40 as shown in FIG. 21B.

The embodiment of the present invention has been described above, and, according to the above-described embodiment, it is possible to obtain the following effects.

(1) Since the rotor 40 and the shaft 30 are fastened together as a result of the pieces 70 and 80 moving horizontally by the centrifugal force which is generated by the rotation of the rotor 40, the rotor 40 only has to be put onto the shaft 30.

Figure 1:
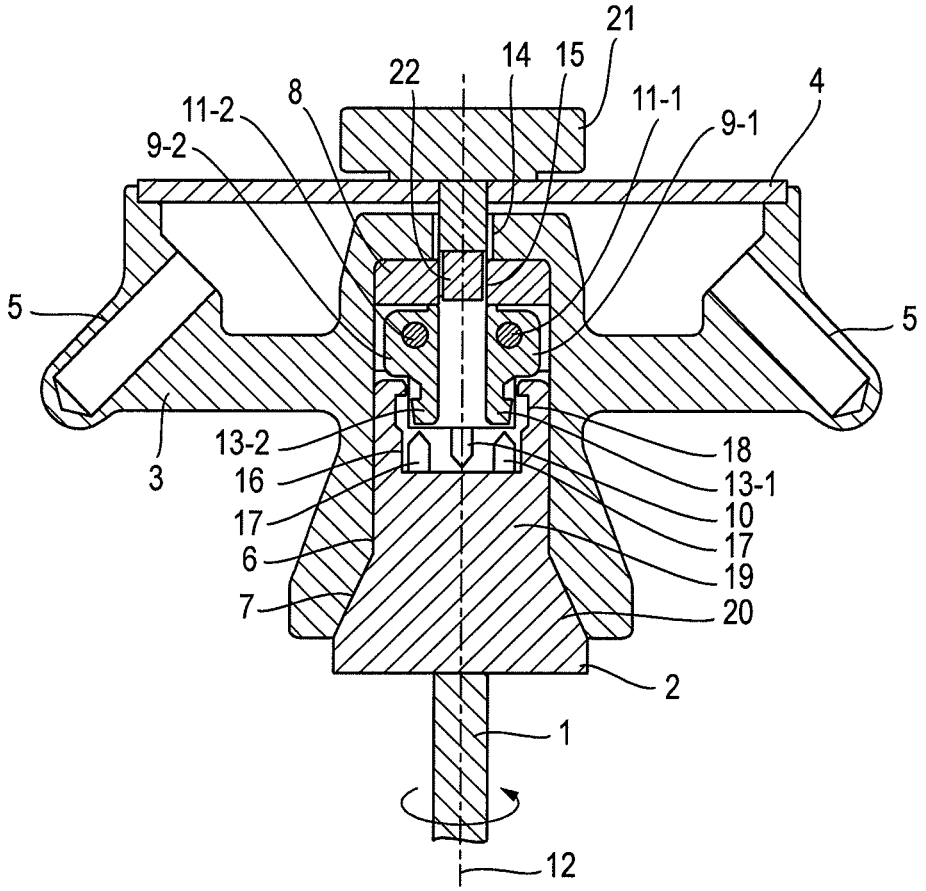
FIG. 1 PRIOR ART
FIG. 1 is a sectional view of a conventional rotor attachment structure.

(2) In the conventional structure shown in FIG. 1 which uses the centrifugal force, the male members 9-1 and 9-2 that move by the centrifugal force are supported by pins (the rotating shafts 11-1 and 11-2) and such a structure using the pins makes an assembly operation troublesome; by contrast, in this example, the pieces 70 and 80 only have to be inserted into the piece placement hole 64 of the main body 60 and there is no need for pins, which makes it possible to perform assembly with ease.

(3) Since the two pieces 70 and 80 are structured so that the central parts 71 and 81 thereof overlap one another, it is possible to make the size compact in both the height direction and the horizontal direction and accordingly achieve space saving.

(4) Even when the pieces 70 and 80 do not return due to, for example, the adhesion of a sample and enter a locked state, one motion of inserting the tool 120 into the holes 75 and 87 provided in the pieces 70 and 80 makes it possible to move the pieces 70 and 80 easily and release the locked state.

Figure 22A:
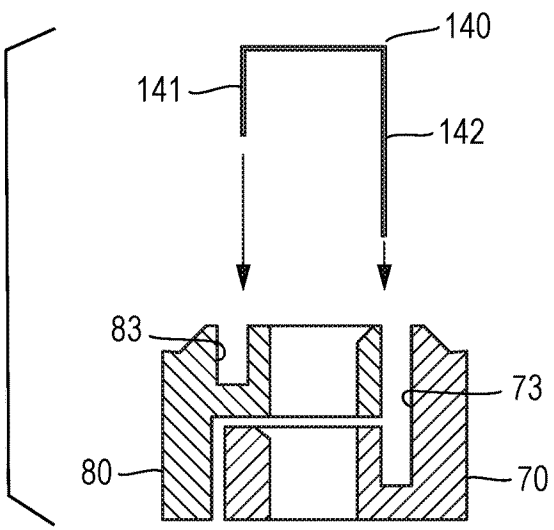
FIG. 22A is a diagram for explaining a comparative example of the leaf spring.
Figure 22B:
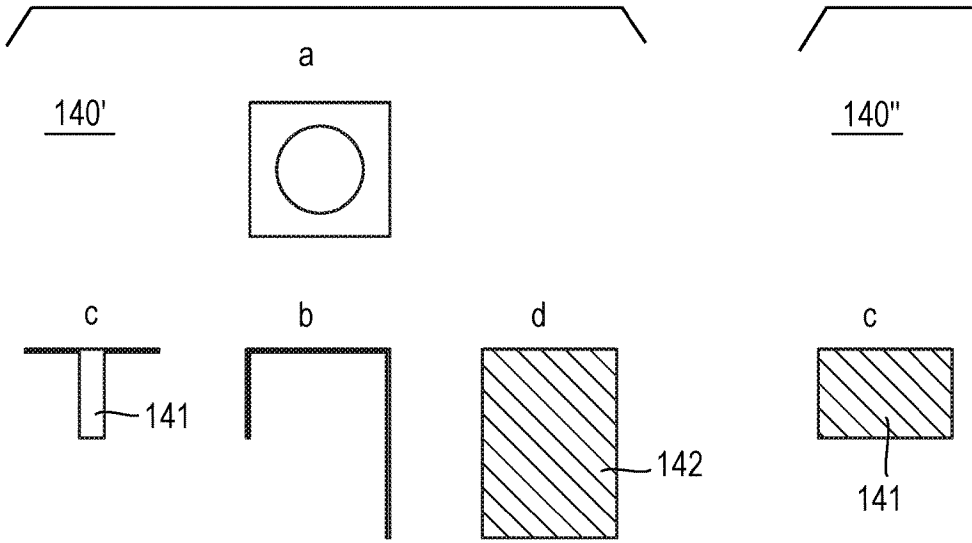
FIG. 22B is a diagram showing a comparative example of the leaf spring.
Figure 22C:
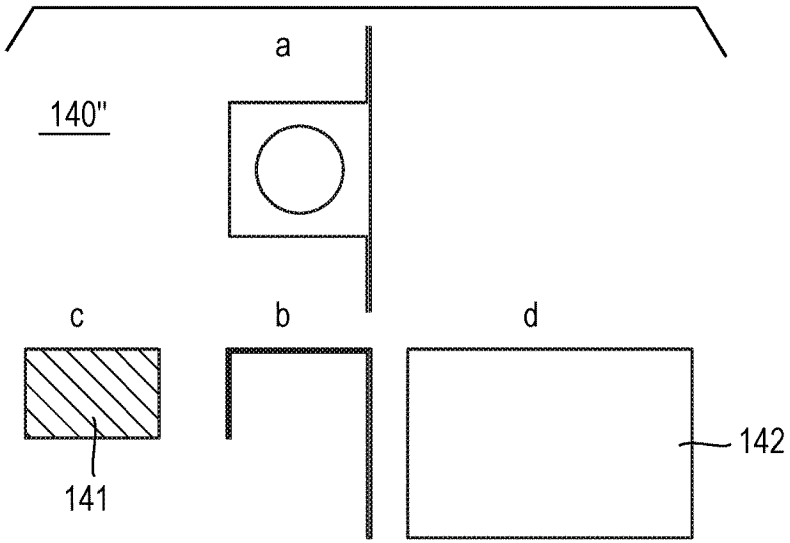
FIG. 22C is a diagram showing a comparative example of the leaf spring.

(5) By providing the leaf spring 90 with a shape shown in FIGS. 9A to 9D and forming the arm portions 94 and 95 so as to have the same shape, it is possible to apply equal spring forces satisfactorily to the two pieces 70 and 80. For instance, if a simple U-shaped leaf spring 140 is adopted as shown in FIG. 22A, since two arm portions 141 and 142 are different in length, to make them have the same spring constant, the leaf spring 140 has the shape of a leaf spring 140' shown in FIG. 22B or the shape of a leaf spring 140" shown in FIG. 22C. The leaf spring 140' shown in FIG. 22B illustrates a case based on the long arm portion 142 with hatch lines, in which the width of the short arm portion 141 has to be reduced, which makes it difficult to use the leaf spring 140' for reasons of strength. On the other hand, the leaf spring 140" shown in FIG. 22C illustrates a case based on the short arm portion 141 with hatch lines, in which the width of the long arm portion 141 becomes excessively large, which makes it difficult to use the leaf spring 140" for reasons of space. In this example, by providing the leaf spring 90 with the shape shown in FIGS. 9A to 9D, it is possible to solve such a strength- or space-related problem.

Figure 23A:
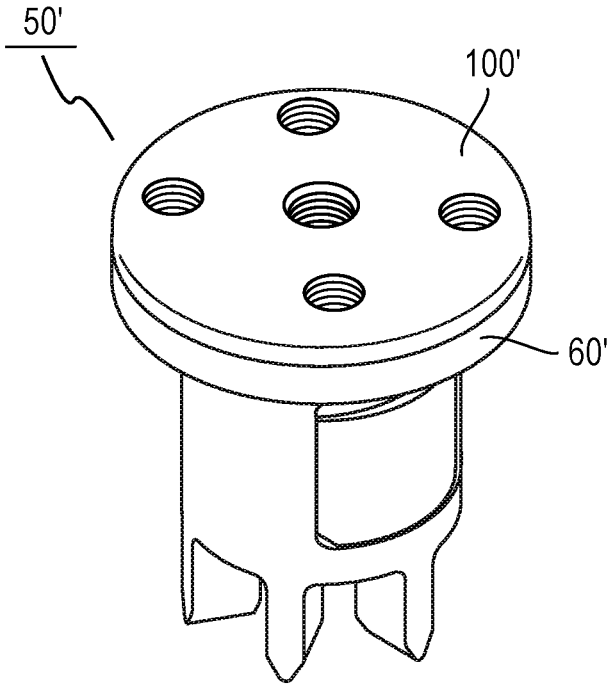
FIG. 23A is a perspective view of a comparative example of the attachment fitting.
Figure 23B:
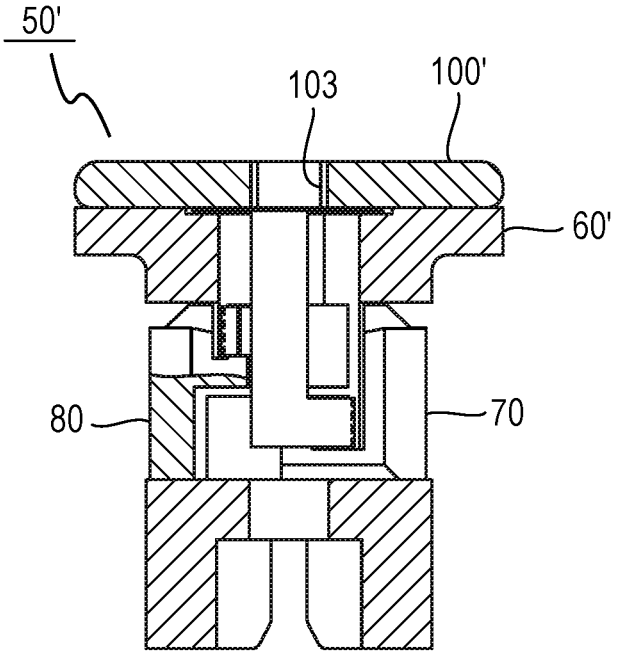
FIG. 23B is a sectional view of the comparative example of the attachment fitting.
Figure 24A:
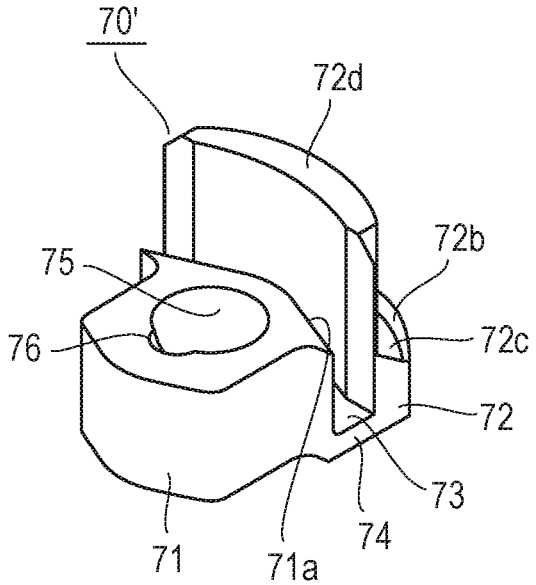
FIG. 24A is a perspective view showing another shape example of the first piece.
Figure 24B:
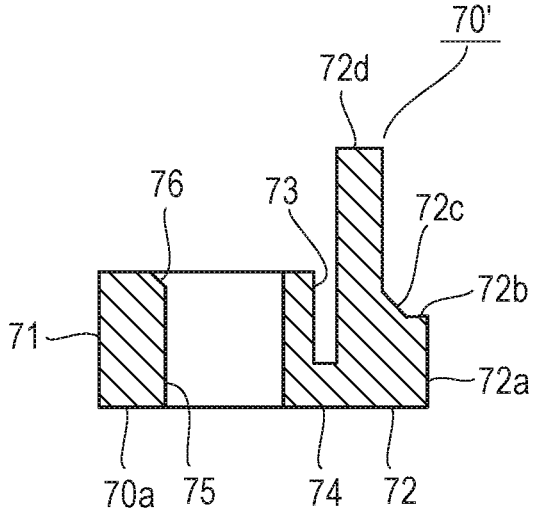
FIG. 24B is a sectional view of the first piece shown in FIG. 24A.
Figure 25A:
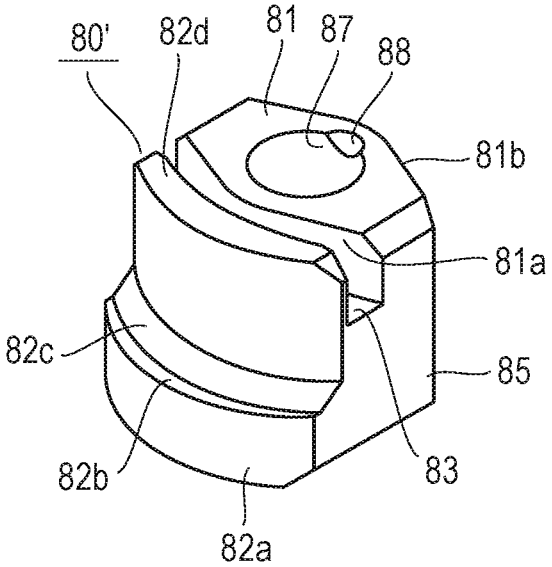
FIG. 25A is a perspective view showing another shape example of the second piece.
Figure 25B:
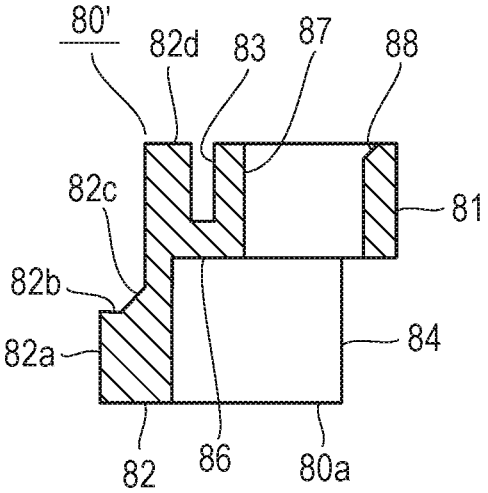
FIG. 25B is a sectional view of the second piece shown in FIG. 25A.

(6) Since the retainer 100 is made thicker than the protrusions 102 in the shape of a cross and has, in the center thereof, the circular cylinder portion 101 which is housed in the depressions 66 of the main body 60, and, in this portion, the threaded hole 103 is formed, it is possible to make the threaded hole 103 large in length. For example, if an attachment fitting 50' structured as shown in FIGS. 23A and 23B is adopted, in which a main body 60' and a retainer 100' have the shapes shown in FIGS. 23A and 23B and the retainer 100' is simply placed on the main body 60', the retainer 100' has to be thinner to reduce the size in the height direction, that is, the threaded hole 103 decreases in length. The threaded hole 103 engages the screw 122*a* of the tool 120 that releases the locked state; therefore, a decrease in the length of the threaded hole 103 becomes a problem for reasons of strength and causes breakage to occur easily. By contrast, in this example, it is possible to ensure the strength of the threaded hole 103.

In the above-described embodiment, the pieces 70 and 80 have the first inclined surfaces 72*c* and 82*c* and the second inclined surfaces 72*b* and 82*b* formed in the side wall portions 72 and 82, respectively, on the upper-end sides thereof; however, the positions in which the first inclined surfaces 72*c* and 82*c* and the second inclined surfaces 72*b* and 82*b* are formed are not limited thereto and may be changed.

Figure 26B:
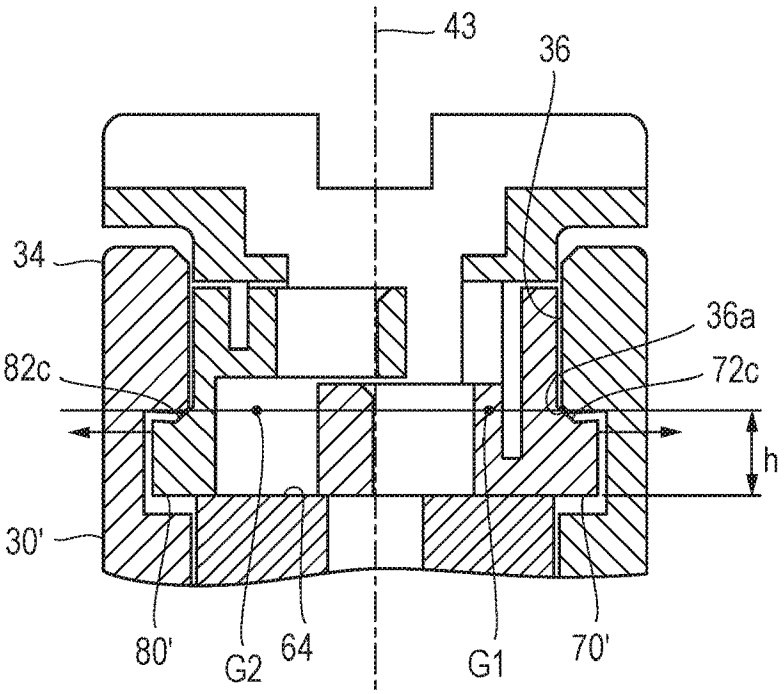
FIG. 26B is a sectional view showing the relationship between the first and second pieces shown in FIGS. 24A, 24B and FIGS. 25A, 25B and the rotor coupling portion at the time of rotation.
Figure 26A:
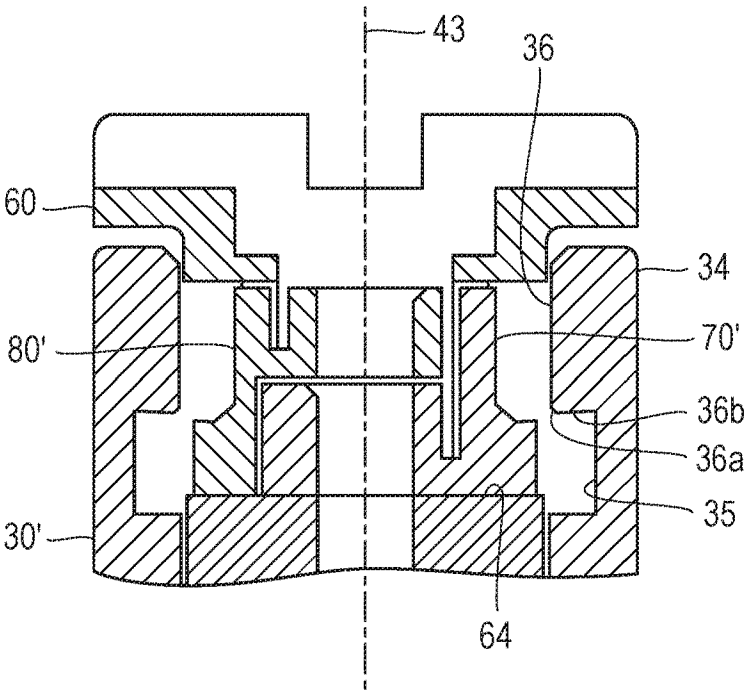
FIG. 26A is a sectional view showing the relationship between the first and second pieces shown in FIGS. 24A, 24B and FIGS. 25A, 25B and the rotor coupling portion when rotation is stopped.

FIGS. 24A and 24B and FIGS. 25A and 25B show the shapes of pieces 70' and 80' obtained by changing the positions in which the first inclined surfaces 72*c* and 82*c* and the second inclined surfaces 72*b* and 82*b* are formed, and FIGS. 26A and 26B show the relationship between the pieces 70' and 80' and the rotor coupling portion 34 when the rotation is stopped and at the time of rotation in a manner similar to that of FIGS. 16A and 16B described earlier. Portions in FIGS. 24A and 24B corresponding to those of FIGS. 7A to 7F and portions in FIGS. 25A and 25B corresponding to those of FIGS. 8A to 8F are identified with the same reference characters.

In this example, the pieces 70' and 80' have the first inclined surfaces 72*c* and 82*c* and the second inclined surfaces 72*b* and 82*b* in positions lower than the upper ends of the side wall portions 72 and 82, not on the upper-end sides of the side wall portions 72 and 82; as a result, in a shaft 30', as shown in FIGS. 26A and 26B, compared to the shaft 30 shown in FIGS. 5A to 5C, the length of the ring-shaped projection 36 in the direction of the rotation central axis 43 is made larger and the positions of the first shaft inclined surface 36*a* and the second shaft inclined surface 36*b* are made lower.

In FIG. 26B, G1 denotes the position of the center of gravity of the piece 70' and G2 denotes the position of the center of gravity of the piece 80'. These centers of gravity G1 and G2 have the same height h in the direction of the rotation central axis 43, and the height position in the direction of the rotation central axis 43 in which the first inclined surfaces 72*c* and 82*c* of the pieces 70' and 80' and the first shaft inclined surface 36*a* of the shaft 30' make contact with each other at the time of rotation is made to coincide with the height position of the centers of gravity G1 and G2 in this example as shown in FIG. 26B.

As described above, by making the height position in which the first inclined surfaces 72*c* and 82*c* and the first shaft inclined surface 36*a* make contact with each other coincide with the height position of the centers of gravity G1 and G2 of the pieces 70' and 80', a force that inclines the pieces 70' and 80' is not generated in the pieces 70' and 80' making contact with the first shaft inclined surface 36*a* by the rotation, which makes it possible to prevent the pieces 70' and 80' from being inclined.

Thus, adopting the shapes of such pieces 70' and 80' in place of the above-described pieces 70 and 80 advantageously prevents problems, such as the occurrence of a situation in which, for example, the pieces are inclined, make contact with the second shaft inclined surface 36*b* and stick thereto, and jam (enter a locked state).

By bringing the height position in which the first inclined surfaces 70*c* and 80*c* and the first shaft inclined surface 36*a* make contact with each other closer to the height position of the centers of gravity G1 and G2 of the pieces, it is possible to reduce the occurrence of inclination of the pieces, and, in this regard, the height position in which the first inclined surfaces 72*c* and 82*c* of the pieces and the first shaft inclined surface 36*a* make contact with each other may be brought closer to the height position of the centers of gravity G1 and G2 of the pieces so as to be within an acceptable design range.

What is claimed is:

1. A rotor attachment structure to a shaft in a centrifuge, wherein a tip side of the shaft is a rotor coupling portion in a shape of a cylinder, a ring-shaped depression is formed in an inner periphery of the rotor coupling portion and a ring-shaped projection is formed on a side closer to a tip than the ring-shaped depression, a corner of the ring-shaped projection on an inner periphery thereof on a side where the ring-shaped depression is located is chamfered and a first shaft inclined surface is formed, and a face from the first shaft inclined surface to a bottom face of the ring-shaped depression is a second shaft inclined surface which forms an acute angle with the bottom face, and the rotor has a rotor hole into which the shaft is inserted and an attachment fitting is disposed in the rotor hole;

wherein the attachment fitting comprises:

a main body that is housed in the rotor coupling portion;

first and second pieces that are disposed in a piece placement hole formed in the main body so as to pass therethrough in a direction orthogonal to a rotation central axis of the rotor;

a leaf spring that includes a base, two long and short extension portions formed by being bent from both ends of the base in a same direction, and two arm portions formed so as to extend from tips of the extension portions in a shape of a circular arc so as to surround the rotation central axis, the leaf spring with the extension portions and the arm portions which are inserted into the piece placement hole via an opening formed in the main body above the piece placement hole so as to communicate with the piece placement hole; and a retainer that is mounted on the main body and puts the base between the retainer and the main body;

wherein the first piece has a first groove into which the arm portion formed in the long extension portion is inserted and includes, with the first groove placed therebetween, a first side wall portion located on one end side of the piece placement hole and a first central part located on the rotation central axis, the second piece has a second groove into which the arm portion formed in the short extension portion is inserted and includes, with the second groove placed therebetween, a second side wall portion located on another end side of the piece placement hole and a second central part located on the first central part, each of outer side faces of the first side wall portion and the second side wall portion has a shape of a circular arc, and, in each of the outer side faces, a first inclined surface and a second inclined surface corresponding to a shape formed by the first shaft inclined surface and the second shaft inclined surface are formed respectively, in a state in which the rotor is stopped, the first and second pieces are positioned by the arm portions and located in the piece placement hole, when the rotor is rotated by rotation of the shaft, the first and second pieces move by centrifugal force so as to protrude from one end and another end of the piece placement hole, respectively, against a spring force of the leaf spring and the first inclined surfaces make contact with the first shaft inclined surface, and rise of the rotor from the shaft is prevented as a result of the second inclined surfaces making contact with the second shaft inclined surface.

2. The rotor attachment structure according to claim 1, wherein in a direction of the rotation central axis, a height position in which the first inclined surfaces and the first shaft inclined surface make contact with each other and a height position of centers of gravity of the first and second pieces coincide with each other.

3. The rotor attachment structure according to claim 2, wherein a bottom face of the second piece has a shape of a letter U in which the second side wall portion forms an intermediate part of the letter U, and the first central part is shaped so that part thereof is located in the letter U.

4. The rotor attachment structure according to claim 3, wherein holes whose centers coincide with the rotation central axis are formed in a bottom face of the rotor hole, the base, the first and second central parts, and the main body below the piece placement hole so as to pass therethrough, and a threaded hole which coincides with positions of the holes is formed in the retainer so as to pass therethrough, and a portion of the hole of the first central part at an upper-end circumferential edge thereof located on a side opposite to the first groove and a portion of the hole of the second central part at an upper-end circumferential edge thereof located on a side opposite to the second groove are cut and inclined surfaces are formed.

5. The rotor attachment structure according to claim 4, wherein the retainer is made up of a circular cylinder portion in which the threaded hole is formed and protrusions protruding from a periphery on an upper-end side of the circular cylinder portion so as to form a shape of a cross, and in the main body, depressions into which the circular cylinder portion is fitted and a groove into which the protrusions are fitted are formed.

6. The rotor attachment structure according to claim 2, wherein holes whose centers coincide with the rotation central axis are formed in a bottom face of the rotor hole, the base, the first and second central parts, and the main body below the piece placement hole so as to pass therethrough, and a threaded hole which coincides with positions of the holes is formed in the retainer so as to pass therethrough, and a portion of the hole of the first central part at an upper-end circumferential edge thereof located on a side opposite to the first groove and a portion of the hole of the second central part at an upper-end circumferential edge thereof located on a side opposite to the second groove are cut and inclined surfaces are formed.

7. The rotor attachment structure according to claim 6, wherein the retainer is made up of a circular cylinder portion in which the threaded hole is formed and protrusions protruding from a periphery on an upper-end side of the circular cylinder portion so as to form a shape of a cross, and in the main body, depressions into which the circular cylinder portion is fitted and a groove into which the protrusions are fitted are formed.

8. The rotor attachment structure according to claim 1, wherein a bottom face of the second piece has a shape of a letter U in which the second side wall portion forms an intermediate part of the letter U, and the first central part is shaped so that part thereof is located in the letter U.

9. The rotor attachment structure according to claim 8, wherein holes whose centers coincide with the rotation central axis are formed in a bottom face of the rotor hole, the base, the first and second central parts, and the main body below the piece placement hole so as to pass therethrough, and a threaded hole which coincides with positions of the holes is formed in the retainer so as to pass therethrough, and a portion of the hole of the first central part at an upper-end circumferential edge thereof located on a side opposite to the first groove and a portion of the hole of the second central part at an upper-end circumferential edge thereof located on a side opposite to the second groove are cut and inclined surfaces are formed.

10. The rotor attachment structure according to claim 9, wherein the retainer is made up of a circular cylinder portion in which the threaded hole is formed and protrusions protruding from a periphery on an upper-end side of the circular cylinder portion so as to form a shape of a cross, and in the main body, depressions into which the circular cylinder portion is fitted and a groove into which the protrusions are fitted are formed.

11. The rotor attachment structure according to claim 1, wherein holes whose centers coincide with the rotation central axis are formed in a bottom face of the rotor hole, the base, the first and second central parts, and the main body below the piece placement hole so as to pass therethrough, and a threaded hole which coincides with positions of the holes is formed in the retainer so as to pass therethrough, and a portion of the hole of the first central part at an upper-end circumferential edge thereof located on a side opposite to the first groove and a portion of the hole of the second central part at an upper-end circumferential edge thereof located on a side opposite to the second groove are cut and inclined surfaces are formed.

12. The rotor attachment structure according to claim 11, wherein the retainer is made up of a circular cylinder portion in which the threaded hole is formed and protrusions protruding from a periphery on an upper-end side of the circular cylinder portion so as to form a shape of a cross, and in the main body, depressions into which the circular cylinder portion is fitted and a groove into which the protrusions are fitted are formed.

13. A centrifuge that is provided with the rotor attachment structure according to claim 1.

* * * * *